US012571541B2

(12) United States Patent
Graham et al.

(10) Patent No.: US 12,571,541 B2
(45) Date of Patent: Mar. 10, 2026

(54) FIRE PIT

(71) Applicant: AOB Products Company, Columbia, MO (US)

(72) Inventors: Mark Graham, Holland, MI (US); Jeremy Rantz, Columbia, MO (US); Timothy S. Kinney, Warrenton, MO (US); Todd Strobel, Columbia, MO (US); Corey Case, Columbia, MO (US); James Tayon, Moberly, MO (US); Matthew Kinamore, Columbia, MO (US); Ethan O'Keefe, Columbia, MO (US)

(73) Assignee: AOB Products Company, Columbia, MO (US)

( * ) Notice: Subject to any disclaimer, the term of this patent is extended or adjusted under 35 U.S.C. 154(b) by 370 days.

(21) Appl. No.: 18/312,787

(22) Filed: May 5, 2023

(65) Prior Publication Data

US 2023/0358406 A1 Nov. 9, 2023

Related U.S. Application Data

(60) Provisional application No. 63/364,220, filed on May 5, 2022.

(51) Int. Cl.

| | |
|---|---|
| ***F24B 1/18*** | (2006.01) |
| ***A47B 37/04*** | (2006.01) |
| ***F24B 5/02*** | (2006.01) |
| ***F24B 13/00*** | (2006.01) |
| ***F24B 13/04*** | (2006.01) |

(52) U.S. Cl.
CPC ..... *F24B 1/18* (2013.01); *A47B 37/04* (2013.01); *F24B 5/023* (2013.01); *F24B 13/002* (2013.01); *F24B 13/04* (2013.01)

(58) Field of Classification Search
CPC ..... F24B 5/023; F24B 13/002; F24B 13/04; F24B 1/024; F24B 1/18; A47B 37/04
See application file for complete search history.

(56) References Cited

U.S. PATENT DOCUMENTS

| | | | | |
|---|---|---|---|---|
| 1,201,664 A | | 10/1916 | Williams | |
| 2,200,415 A | * | 5/1940 | Cole | F23L 17/00 236/15 C |
| 3,223,077 A | * | 12/1965 | Tsakos | A47J 37/06 126/25 R |

(Continued)

FOREIGN PATENT DOCUMENTS

EP 3112756 * 1/2017

OTHER PUBLICATIONS

Recreational Vortex Fires, fire in a glass box feature custom homes, restaurant and hotels, www.moderustic.com/voretx-Fire.html, downloaded May 3, 2022, 37 pages.

(Continued)

*Primary Examiner* — Alfred Basichas
(74) *Attorney, Agent, or Firm* — Stinson LLP

(57) ABSTRACT

A fire display fire pit for burning pelletized fuel and associated components and methods. The fire display pit can include a conveyor for moving pelletized fuel from a hopper to a burn chamber. The fire pit may be configured to produce flames in a vortex pattern, such as inside a flame tower.

35 Claims, 17 Drawing Sheets

(56) References Cited

U.S. PATENT DOCUMENTS

| | | | | |
|---|---|---|---|---|
| 3,499,432 | A | 3/1970 | Hannebaum | |
| 5,001,993 | A * | 3/1991 | Gramlow | F24B 5/026 126/200 |
| 5,018,455 | A | 5/1991 | Harman | |
| 5,055,031 | A | 10/1991 | Werner | |
| 5,096,467 | A | 3/1992 | Matsui | |
| 5,137,012 | A | 8/1992 | Crossman, Jr. et al. | |
| 5,151,000 | A | 9/1992 | Geraghty et al. | |
| 5,322,646 | A | 6/1994 | Wright et al. | |
| 5,429,495 | A | 7/1995 | Shimek et al. | |
| 5,966,500 | A | 10/1999 | Wollam | |
| 7,097,448 | B2 | 8/2006 | Chesney | |
| 7,175,424 | B2 | 2/2007 | Frink et al. | |
| 8,020,547 | B2 | 9/2011 | Hepper et al. | |
| 8,561,602 | B2 | 10/2013 | Andors et al. | |
| 8,635,995 | B2 | 1/2014 | Kuhne et al. | |
| 8,635,996 | B2 | 1/2014 | Harman et al. | |
| 8,641,413 | B2 | 2/2014 | Chen et al. | |
| 9,163,831 | B2 | 10/2015 | Chen | |
| 9,170,017 | B2 | 10/2015 | Shimek et al. | |
| 9,404,671 | B2 | 8/2016 | Liang | |
| 9,528,707 | B2 | 12/2016 | Atemboski et al. | |
| 9,557,051 | B2 | 1/2017 | Chen | |
| 9,726,368 | B2 | 8/2017 | Chen | |
| 9,845,957 | B2 | 12/2017 | Hill et al. | |
| 9,945,563 | B2 | 4/2018 | Cyris | |
| 10,101,036 | B2 | 10/2018 | Fuller et al. | |
| 10,197,291 | B2 | 2/2019 | Rivera | |
| 10,330,313 | B2 | 6/2019 | Huang | |
| 10,407,254 | B2 | 9/2019 | Kiner et al. | |
| 10,408,459 | B2 | 9/2019 | Hill et al. | |
| 10,670,276 | B2 | 6/2020 | Traeger | |
| 10,920,987 | B2 | 2/2021 | Myers et al. | |
| 11,175,047 | B2 | 11/2021 | Hill et al. | |
| 11,317,761 | B2 | 5/2022 | Traeger | |
| 2003/0194671 | A1 | 10/2003 | Webb | |
| 2009/0293860 | A1 | 12/2009 | Carlson | |
| 2018/0051886 | A1 * | 2/2018 | Myers | F23B 80/04 |
| 2018/0252414 | A1 | 9/2018 | Greiwe | |
| 2021/0341144 | A1 | 11/2021 | Parsons et al. | |
| 2022/0142405 | A1 * | 5/2022 | Kessler | A47J 37/0704 |
| 2022/0235930 | A1 * | 7/2022 | Kaiser | F23B 60/02 |

OTHER PUBLICATIONS

Two photos disclosing a fire display apparatus admitted as prior art, at least as early as May 3, 2022, 2 pages.

* cited by examiner

FIRE PIT

CROSS-REFERENCE TO RELATED APPLICATION

The present application claims priority to U.S. Provisional Application Ser. No. 63/364,220, filed May 5, 2022, the entirety of which is hereby incorporated by reference for all purposes.

FIELD

The present disclosure generally relates to fire pits, and more particularly to fire pits that burn solid, pelletized fuel.

BACKGROUND

Fire pits generate heat and provide a gathering place for people on decks, patios, and the like. Frequently, fire pits burn a gas, such as propane, to generate a fire.

SUMMARY

In one aspect, a fire display fire pit for burning pelletized fuel comprises a base configured to rest on a support surface. A hopper is supported by the base and configured to hold the pelletized fuel. A burn chamber supported by the base has a combustion space for burning the fuel. A fuel conveyor is supported by the base and arranged to dispense the pelletized fuel from the hopper toward the combustion space of the burn chamber. A combustion air supply system is supported by the base. The combustion air supply system is configured to deliver air to the combustion space of the burn chamber. The combustion air supply system includes ducting arranged to deliver air to the combustion space of the burn chamber and a blower configured to move air in the ducting toward the combustion space of the burn chamber.

In another aspect, a fire display fire pit for burning pelletized fuel comprises a base configured to rest on a support surface. A hopper is supported by the base and configured to hold the pelletized fuel. A burn chamber supported by the base has a combustion space for burning the pelletized fuel. A fuel conveyor supported by the base is arranged to dispense the pelletized fuel toward the combustion space of the burn chamber. A flame tower is disposed above the burn chamber and supported by the base. The flame tower has a flame tower interior arranged to receive flames produced by the burning of the pelletized fuel in the combustion space of the burn chamber. The flame tower includes a plurality of air outlets oriented to direct air into the flame tower interior in a manner that imparts a vortex effect on the flames produced by the burning of the pelletized fuel in the combustion space of the burn chamber. An air supply system is configured to supply air to the plurality of air outlets. The air supply system includes ducting arranged to deliver air to the plurality of air outlets and a blower configured to move air in the ducting toward the air outlets.

In another aspect, a fire display fire pit for burning pelletized fuel comprises an ornamental housing and a burn chamber having a combustion space for burning the fuel. The burn chamber is disposed in the ornamental housing. A hopper is configured to hold the pelletized fuel, the hopper disposed in the ornamental housing. A fuel conveyor is disposed in the ornamental housing. The fuel conveyor is arranged to dispense the fuel toward the combustion space of the burn chamber. A flame tower extends upward from the ornamental housing. The flame tower is disposed above the burn chamber and has a flame tower interior arranged to receive flames produced by the burning of the pelletized fuel in the combustion space of the burn chamber.

In another aspect, a fire display fire pit for burning solid pelletized fuel comprises a base configured to rest on a support surface. A burn chamber is supported by the base and has a combustion space for burning the fuel. A first hopper is supported by the base and is configured to hold the fuel. A first fuel conveyor is supported by the base and is arranged to dispense the fuel held by the first hopper toward the combustion space of the burn chamber. A second hopper is supported by the base and configured to hold the fuel. A second fuel conveyor supported by the base is arranged to dispense the fuel held by the second hopper toward the combustion space of the burn chamber.

In another aspect, a fire display fire pit for burning pelletized fuel comprises a base configured to rest on a support surface. A hopper is supported by the base and configured to hold the fuel. A burn chamber is supported by the base and has a combustion space for burning the fuel. A fuel conveyor is supported by the base and arranged to dispense the fuel toward the combustion space of the burn chamber. The fuel conveyor includes a fuel outlet through which the fuel is delivered toward the combustion space of the burn chamber and a fuel inlet through which the fuel enters the fuel conveyor. A bottom of the fuel inlet is disposed at an elevation lower than a bottom of the fuel outlet. A flame tower is disposed above the burn chamber and has a flame tower interior arranged to receive flames produced by the burning of the fuel in the combustion space of the burn chamber.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
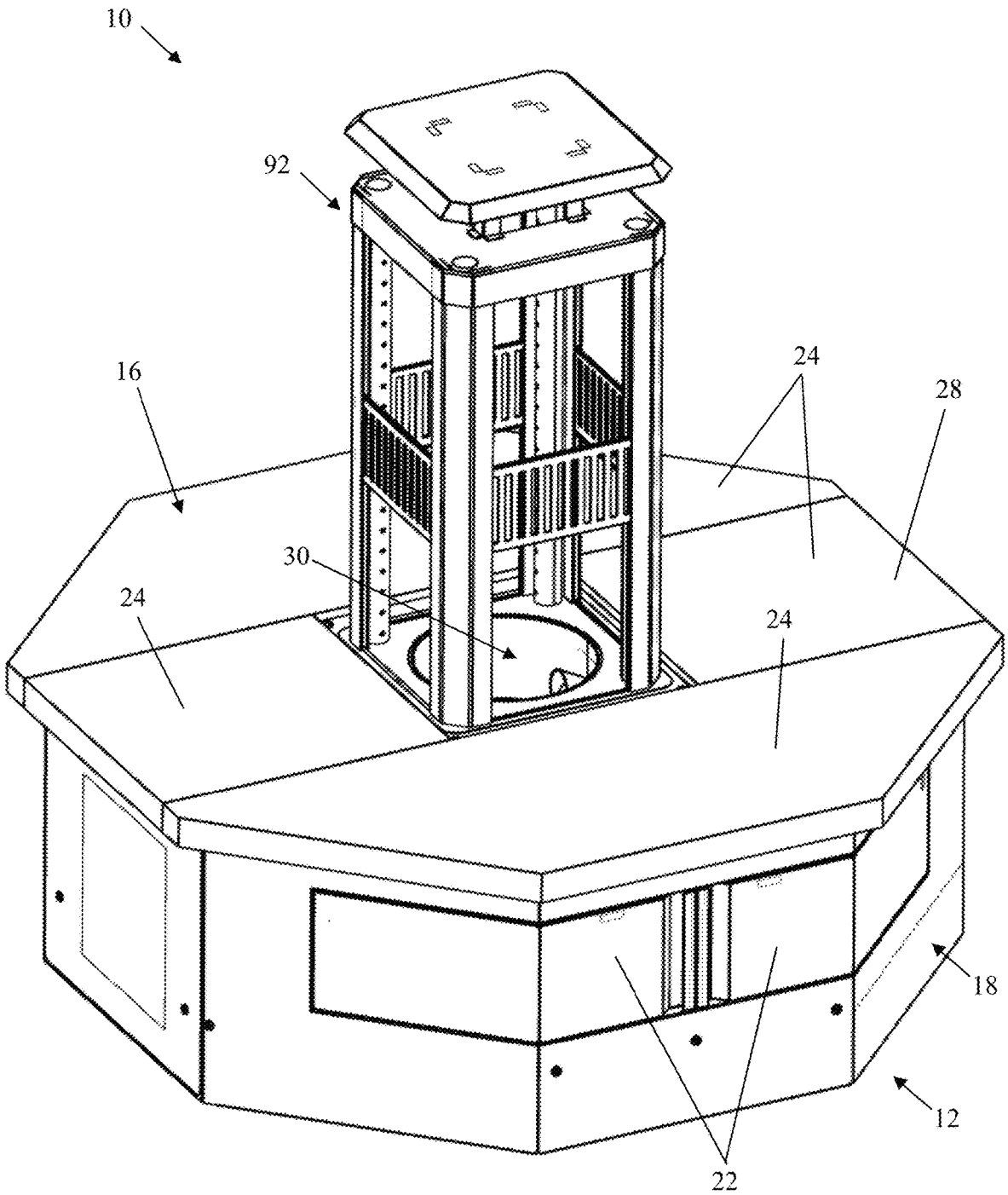
FIG. 1 is a perspective of a fire pit according to one embodiment of the present disclosure.
Figure 2:
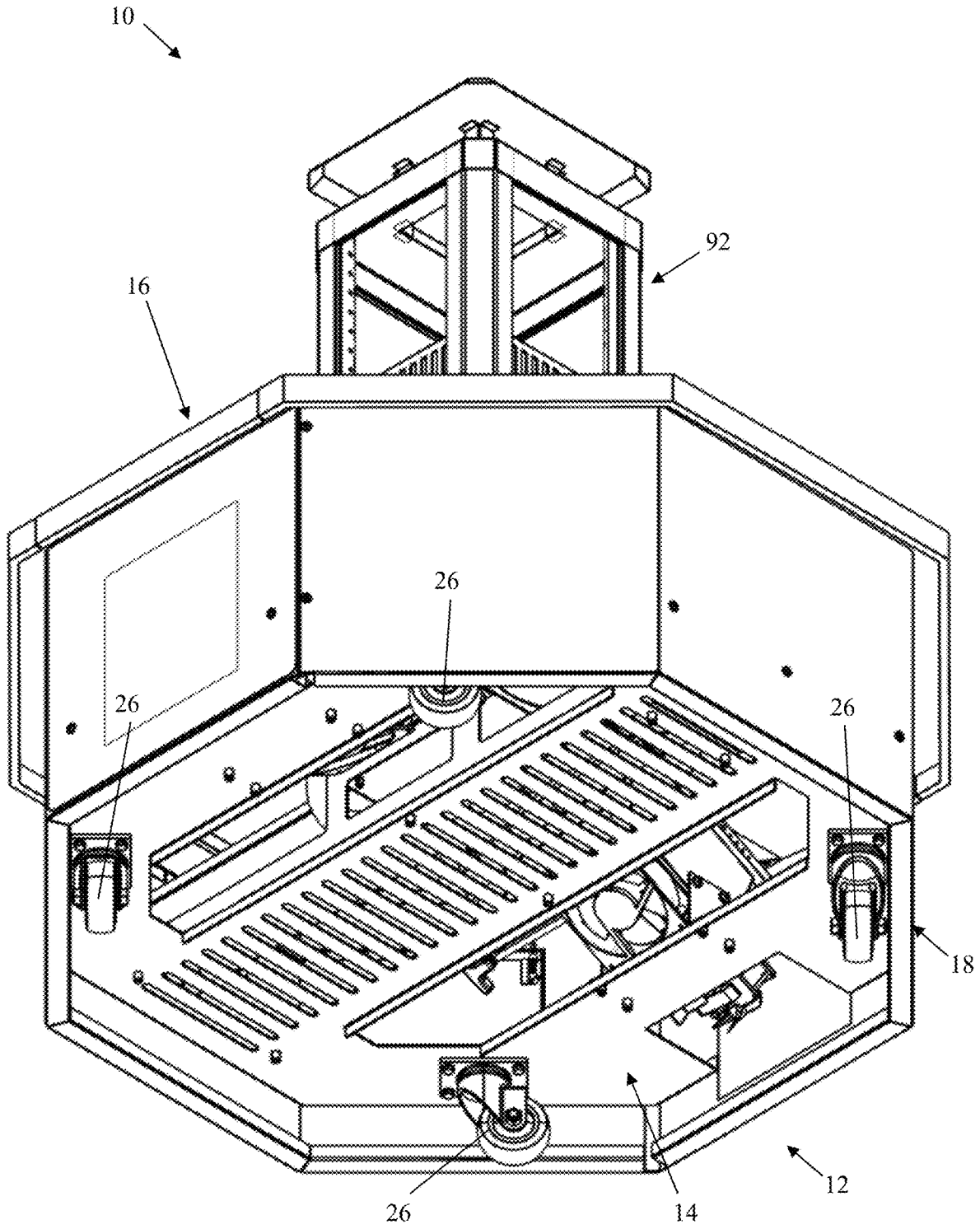
FIG. 2 is a bottom perspective of the fire pit.
Figure 3:
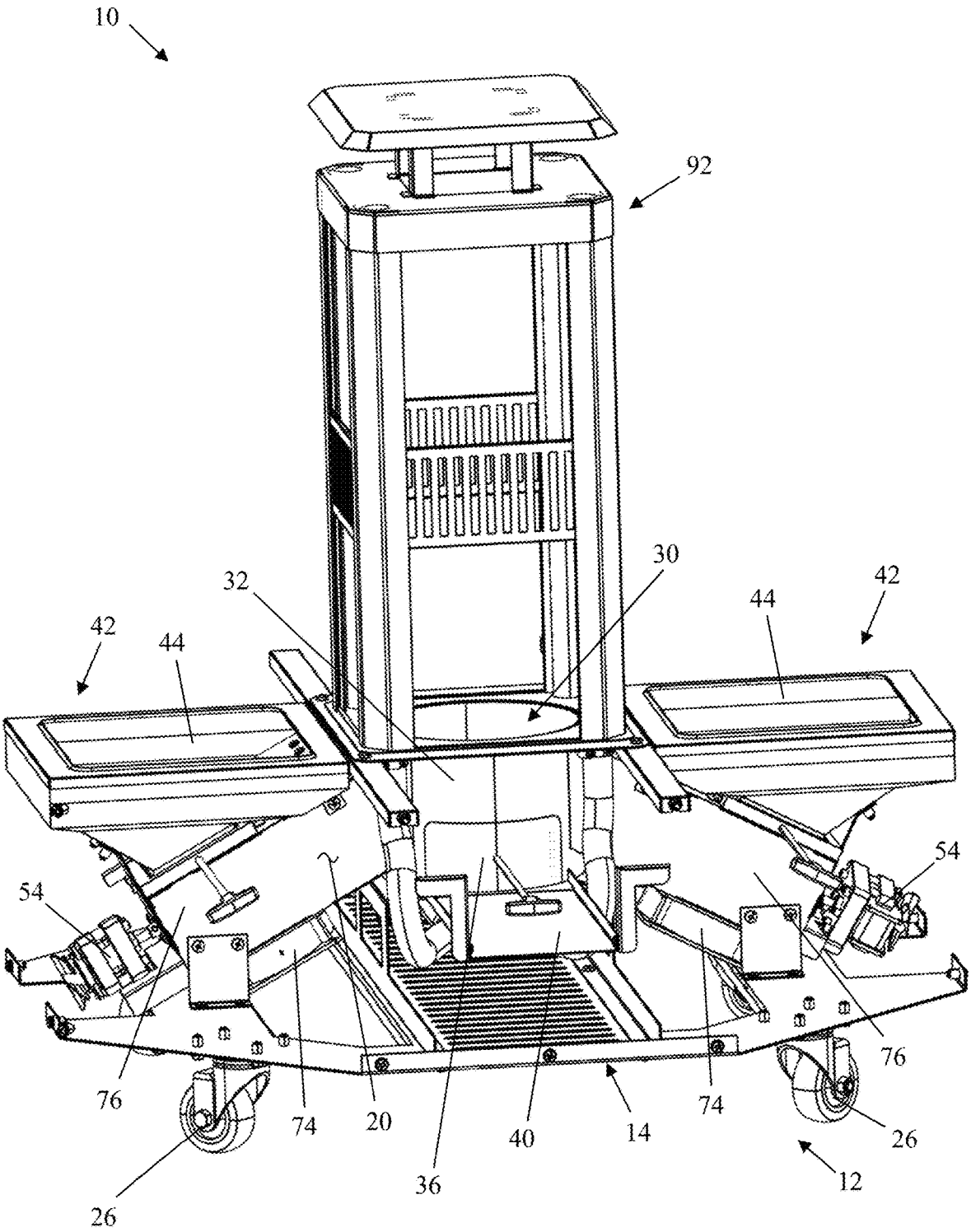
FIG. 3 is a front perspective of the fire pit with elements hidden from view to reveal interior details.
Figure 4:
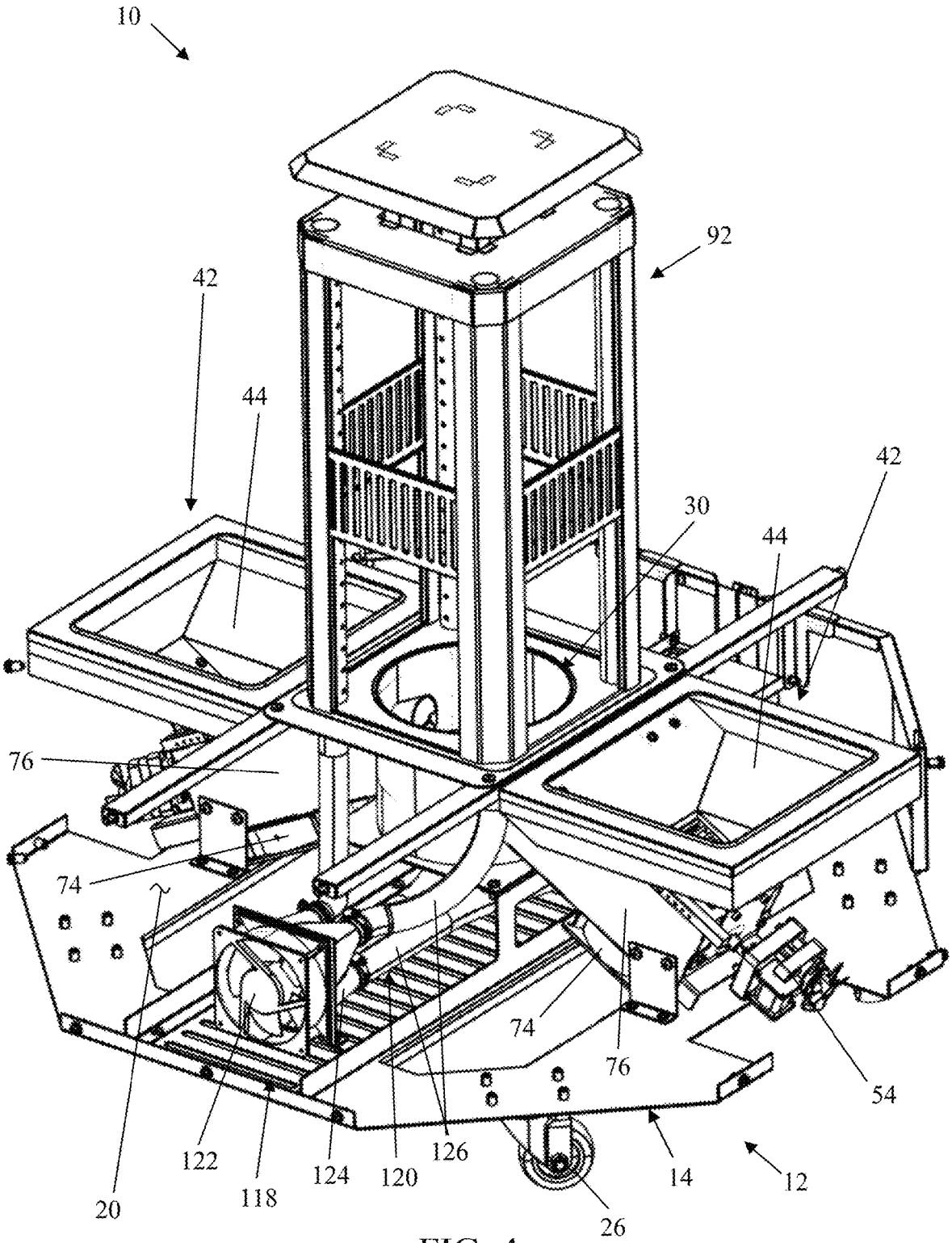
FIG. 4 is a rear perspective of the fire pit with elements hidden from view to reveal interior details.
Figure 5:
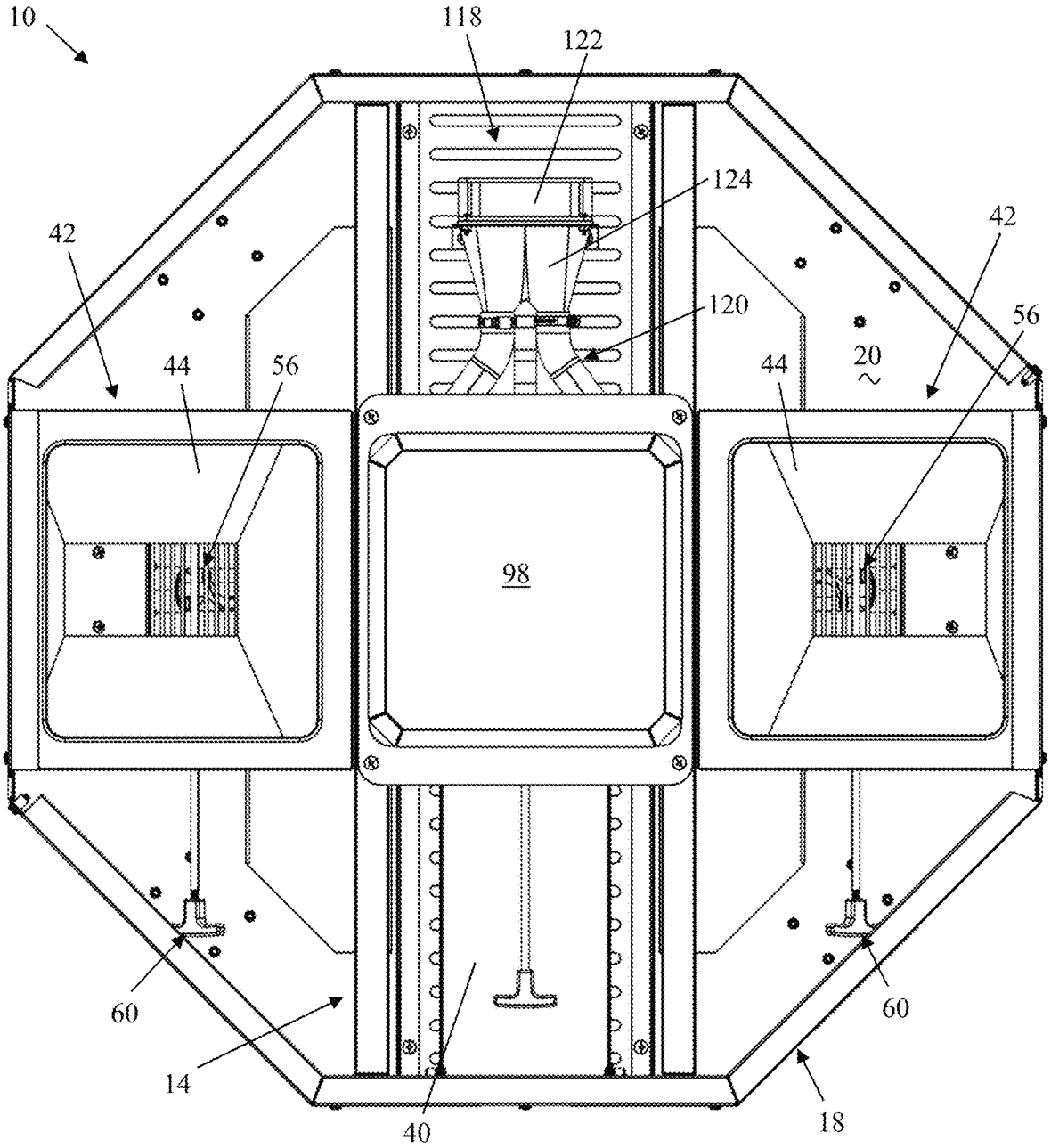
FIG. 5 is a plan view of the fire pit with elements hidden from view to reveal interior details.
Figure 6:
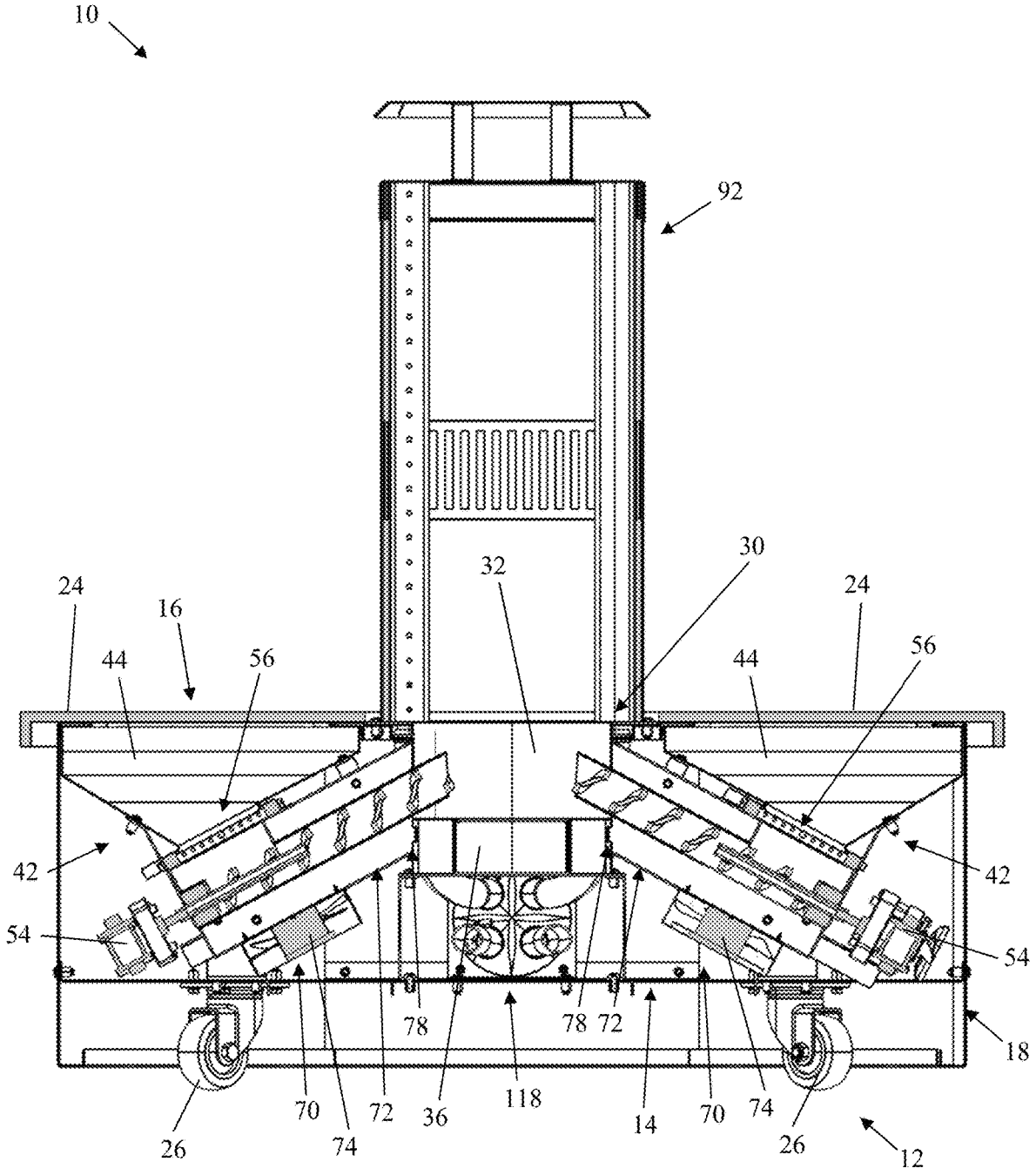
FIG. 6 is a cross-section of the fire pit.

Referring to FIGS. 1-6, a fire display fire pit according to one embodiment of the present disclosure is generally indicated by reference numeral 10. The fire pit 10 burns solid pelletized fuel, such as wooden pellets, to generate a fire. The fire pit 10 may use other types of pelletized fuel.

The fire pit 10 includes a base or housing 12 configured to rest on a support surface (not shown) such as the ground, a deck, a patio, etc. The base 12 includes a framework 14 (e.g., a base plate, struts, etc.), a platform 16 supported by the framework, and a shroud 18 supported by the framework. The platform 16 overlies the shroud 18. The platform 16 and shroud 18 bound an interior 20 of the base 12 which contains several elements or components of the fire pit 10. Desirably, the arrangement provides an ornamental or decorative finished and appeasing appearance of the fire pit 10. In the illustrated embodiment, the shroud 18 comprises eight side walls arranged in an octagon configuration, although other shapes are within the scope of the present disclosure. The platform 16 has a peripheral lip that extends outward of the shroud 18. The shroud 18 includes one or more doors 22 for enabling a user or operator to access the interior 20 of the base 12 and components contained therein. The platform 16 includes a plurality of panels 24 supported by the framework 14. In one embodiment, the panels 24 simply rest on the framework 14 and can be lifted off to provide additional access to the interior 20 of the base 12. In another embodiment, the panels 24 may be secured to the framework 14, such as with fasteners. The illustrated platform 16 includes four panels 24, two end panels and two middle or cover panels disposed between the end panels. The panels 24 may be made of any suitable material such as ceramic or metal. The base 12 includes a plurality of casters 26 which engage the support surface and permit the fire pit 10 to be easily moved across the support surface. The casters 26 also space the lower end of the shroud 18 from the support surface, thereby defining a gap there-between through which air can flow through and under the base 12. The base plate of the framework 14 includes one or more vents or openings which permit air to flow into the interior 20 of the base 12, for reasons that will become apparent. In other embodiments, the base 12 may include feet (not shown) instead of or in addition to the casters.

As illustrated, desirably the fire pit 10 is in the form of a furniture component (e.g., patio furniture). This provides a more finished and appeasing appearance to the fire pit 10, making it more suitable in an outdoor living environment (e.g., patio) of the user or outdoor environment of a dining or other establishment. The base 12 can be configured to serve as a furniture component, such as a table, an ottoman, an end table, a display table, or a storage cabinet. In the illustrated embodiment, the base 12 is in the form of a display table (e.g., a fire table). The platform 16 has a tabletop surface 28. The tabletop surface 28 is formed by the panels 24. The tabletop surface 28 increases the usefulness of the fire fit 10 by permitting persons to place objects (e.g., glasses, plates, etc.) thereon and promotes persons to gather around the fire fit. It is understood the fire pit may take the form of other types of furniture.

Figure 14:
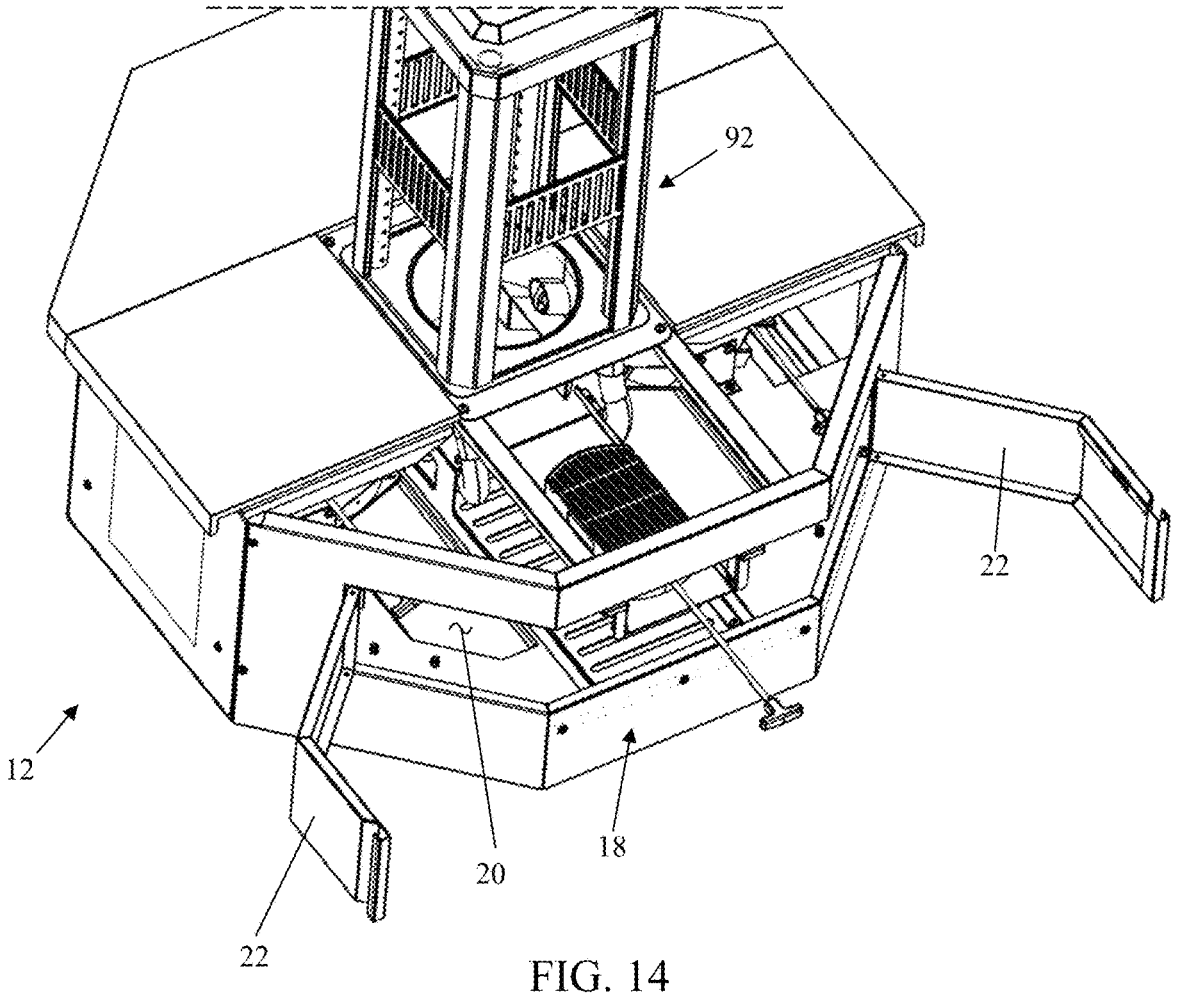
FIG. 14 is a perspective of the fire pit with doors thereof in an open position and other elements hidden from view to reveal interior details.

Referring to FIGS. 1 and 3-9, the fire pit 10 includes a burn chamber 30 where the fuel is burned to produce flames. The burn chamber 30 is supported by the base 12 and is disposed in the interior 20 of the base. The burn chamber 30 includes a burn chamber housing or pot 32 having a combustion space 34 for burning the fuel. The burn chamber 30 includes an ash tray 36 for collecting the ashes generated by the burning fuel. The ash tray 36 is removably received in the burn chamber housing 32. The burn chamber housing 36 includes an ash tray receiving space 38 disposed below the combustion space 34. Together, the ash tray 36 and the burn chamber housing 32 form a floor which generally separates the combustion space 34 and the ash tray receiving space 38 and on which the fuel burns. The base 12 includes an ash tray support 40 on which the ash tray 36 rests when the ash tray is in the ash tray receiving space 38. The ash tray support 40 also provides a platform on which the ash tray 36 can slide to move the ash tray into and out of the ash tray receiving space 38 (see FIG. 14).

The fire pit 10 includes a fuel delivery system 42 for delivering fuel to the burn chamber 30. The fuel delivery system 42 is supported by the base 12 and is contained within the interior 20 of the base. The facilities the finished and appeasing appearance of the fire pit 10. Some prior art fire pits have a hopper that is visible to the user, which makes the fire pit visually less attractive. In the illustrated embodiment, the fire pit 10 includes two fuel delivery systems 42, which are generally mirror images of one another. Accordingly, one fuel delivery system 42 will now be described with the understand the description also applies to the other fuel delivery system. The fire pit 10 may include more or fewer than two fuel delivery systems 42.

Figure 7:
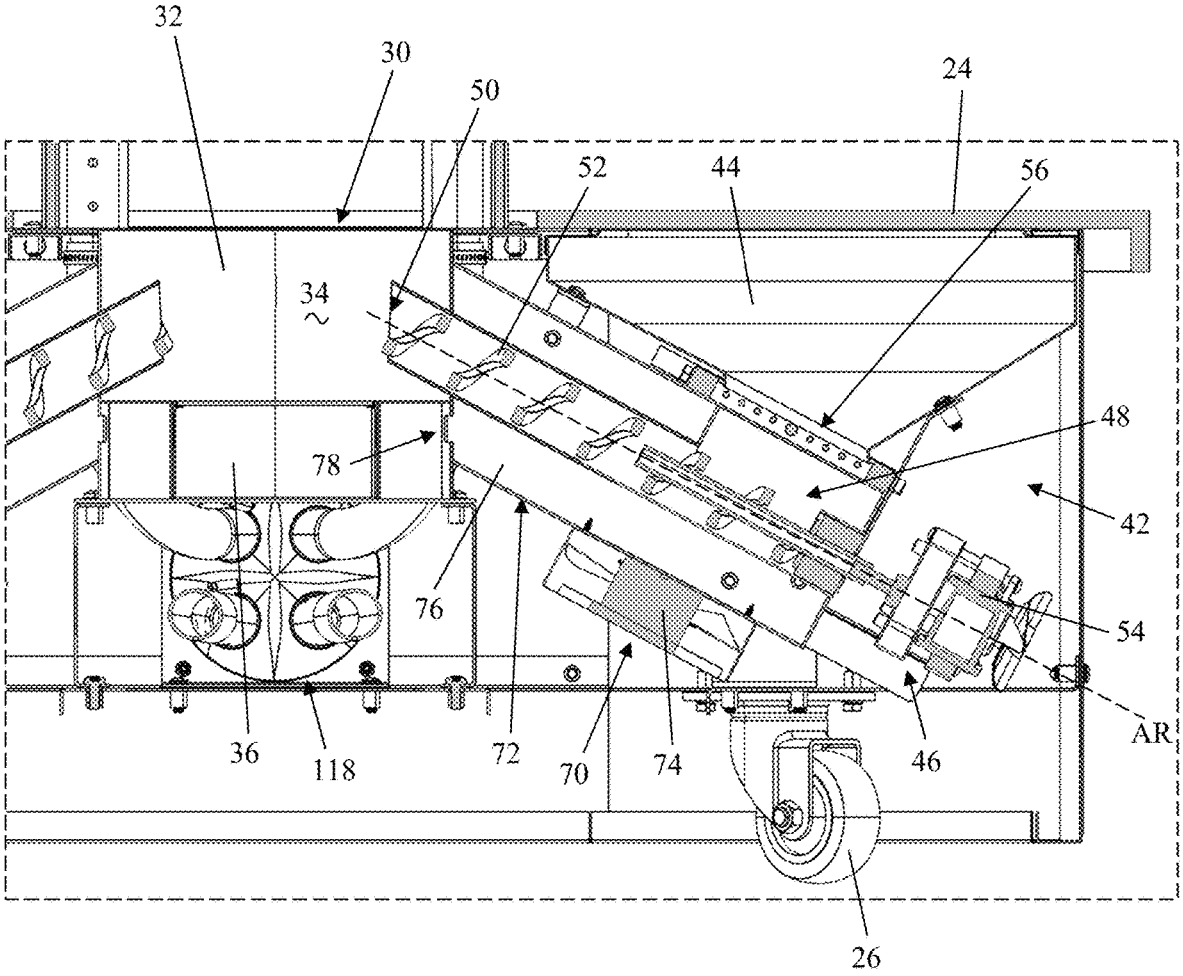
FIG. 7 is an enlarged portion of the cross-section of FIG. 6.
Figure 8:
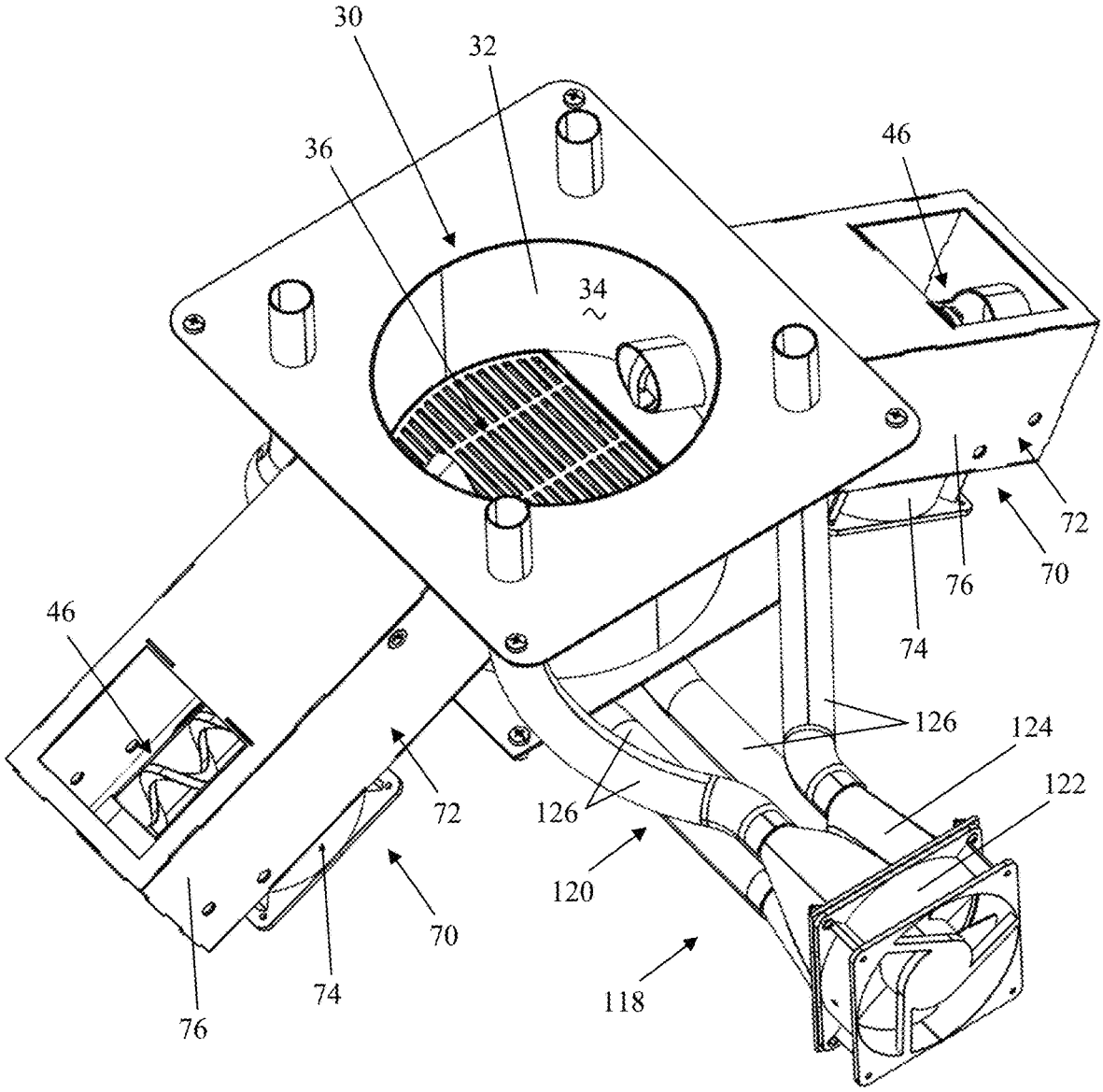
FIG. 8 is a perspective of a burn chamber, fuel conveyors, and forced air system of the fire pit.
Figure 9:
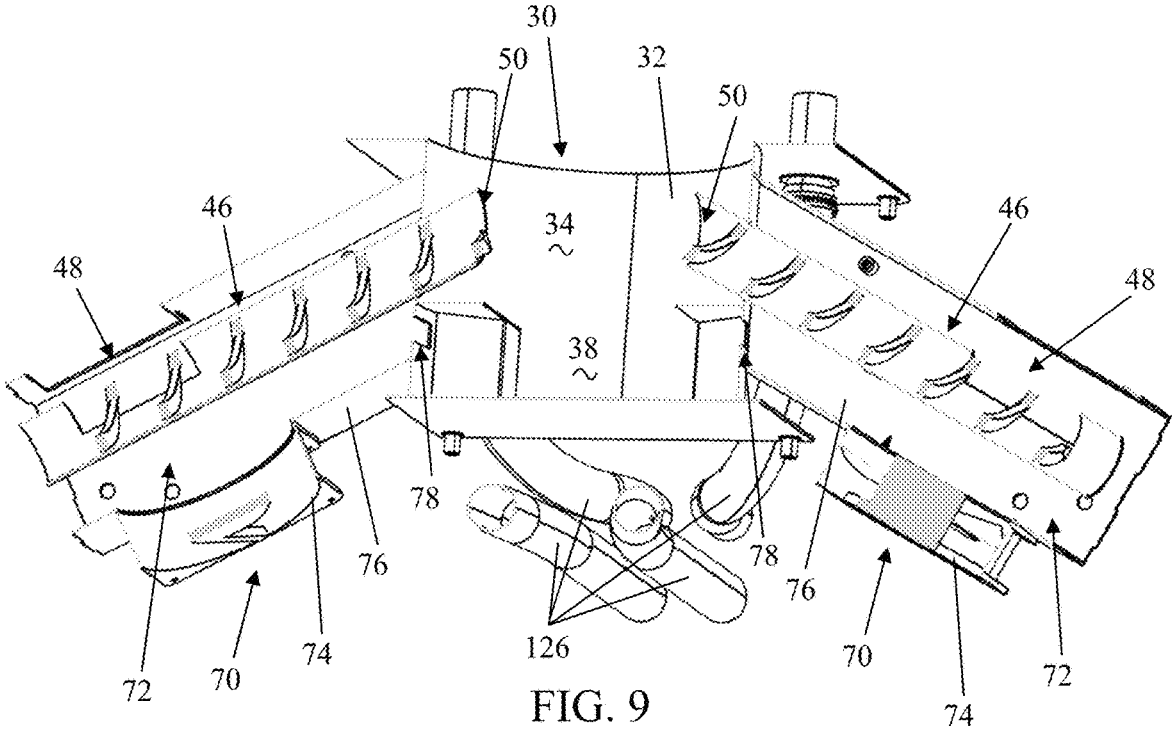
FIG. 9 is a cross-sectional perspective of the burn chamber and the fuel conveyors.
Figure 10:
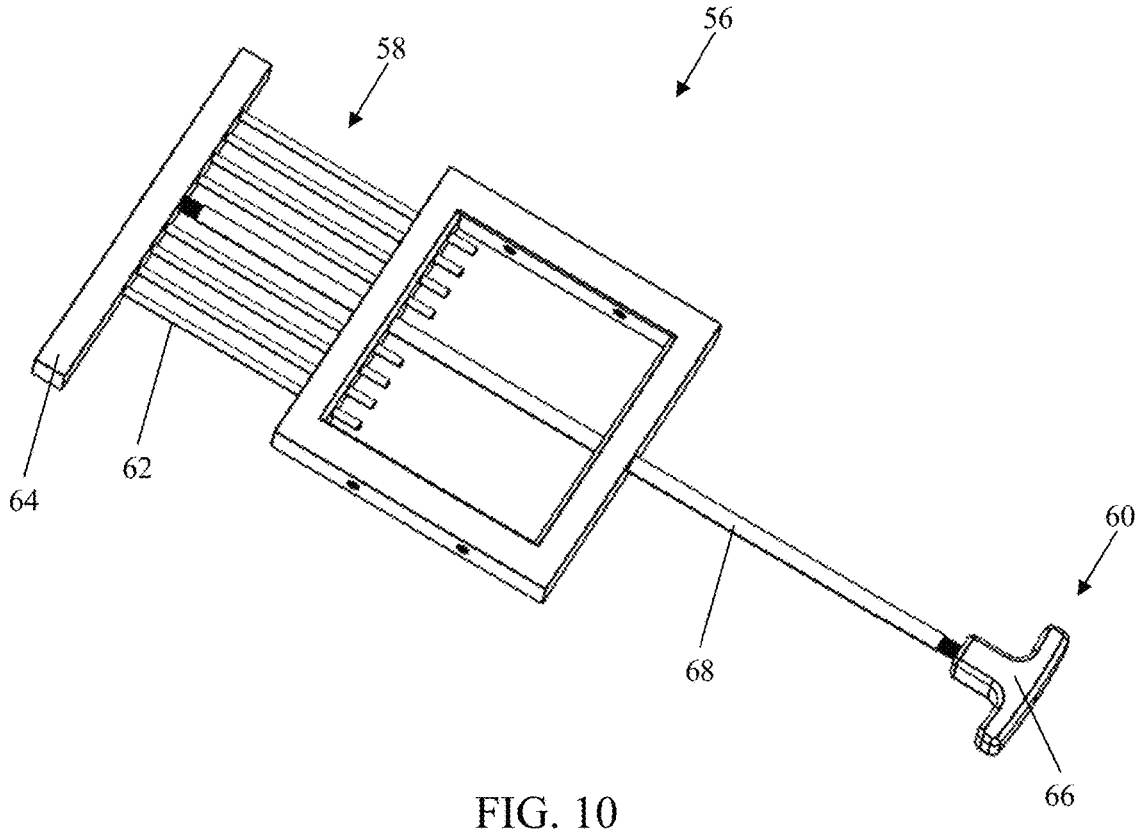
FIG. 10 is a perspective of a fuel valve of the fire pit in an open configuration.
Figure 11:
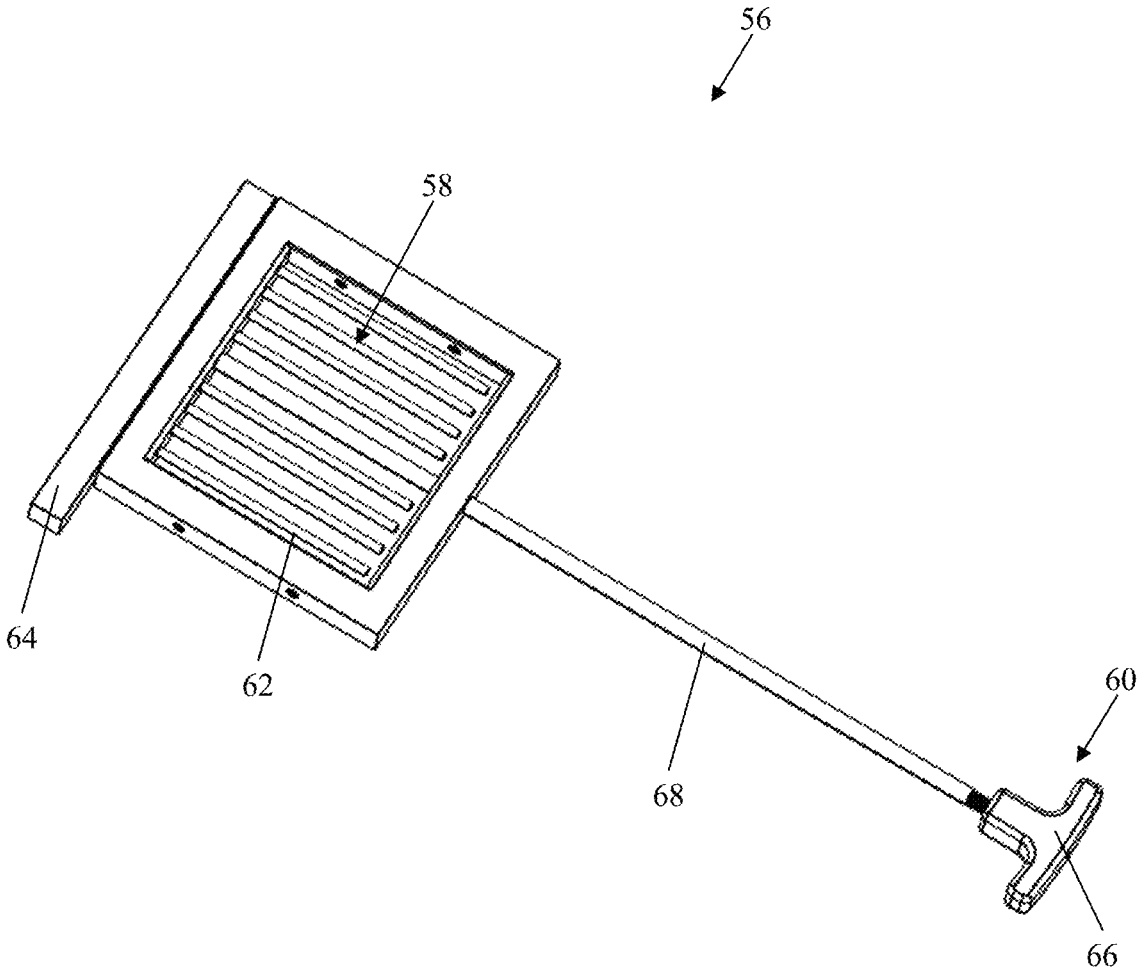
FIG. 11 is a perspective of the fuel valve in a closed configuration.

The fuel delivery system 42 includes a hopper 44 and a fuel conveyor 46. The hopper 44 is configured to hold the fuel. The platform 16 of the base 12 overlies the hopper 44 and hides the hopper from view. In the illustrated embodiment, one of the panels 24 (e.g., a cover panel) of the platform 16 acts as a lid and covers the hopper 44 and is removable (from the remainder of the platform) to access the hopper to load more fuel into the hopper. The platform 16 of the base 12 also overlies the fuel conveyor 46 and hides the fuel conveyor from view. The fuel conveyor 46 is arranged to dispense or move the fuel from the hopper 44 toward (specifically, to) the combustion space 34 of the burn chamber 30. The fuel conveyor 44 is slanted upward such that the fuel conveyor raises the fuel as the fuel conveyor moves the fuel toward the combustion space 34. The fuel conveyor 46 includes a fuel inlet 48 (FIG. 7) through which the fuel enters the fuel conveyor (from the hopper 44 via gravity) and a fuel outlet 50 through which the fuel leaves the fuel conveyor and is delivered to the combustion space 34 of the burn chamber 30. The bottom of the fuel inlet 48 is disposed at an elevation that is lower than the bottom of the fuel outlet 50. Desirably, the entire fuel inlet 48 is disposed at a lower elevation of the fuel outlet 50, as shown. The fuel outlet 50 is disposed in the burn chamber 30 (such that the fuel conveyor 46 delivers the fuel directly to the burn chamber). The slanted arrangement of the fuel conveyor 46 permits the hopper 44 to be larger, and therefore hold more fuel, reducing how often a user need to refill the hopper with fuel, while still being hidden from view by the base 12. The fuel conveyor 46 includes a fuel mover 52 for moving the fuel and a prime mover 54 for driving movement of the fuel mover. The fuel mover 52 moves the fuel through the fuel outlet 50 and into the combustion space 34 of the burn chamber 30. In the illustrated embodiment, the fuel mover 52 comprises an auger and the prime mover 54 comprises an electric motor for rotating the auger. The auger 52 rotates about an axis of rotation AR to move the fuel from the fuel inlet 48 to the fuel outlet 50. The fuel conveyor 46 is arranged with respect to the base 12 such that the axis of rotation AR is oriented at an upward angle as the axis of rotation extends toward the burn chamber 30, as shown in FIG. 7. Other configurations of the fuel conveyor are within the scope of the present disclosure.

Figure 15:
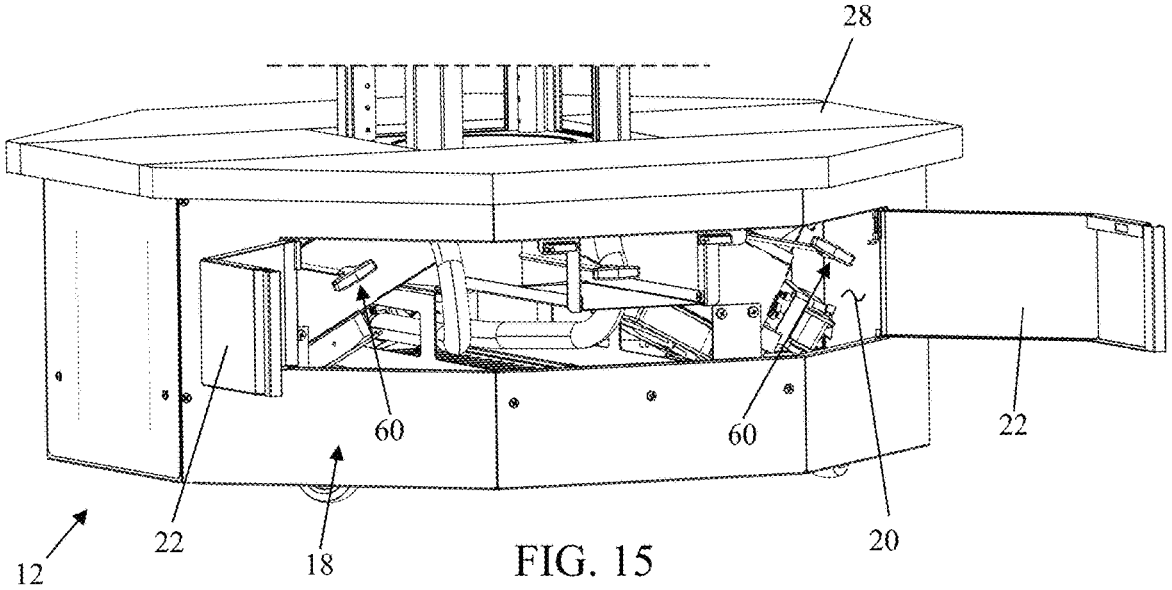
FIG. 15 is another perspective of the fire pit with the doors thereof in an open position.
Figure 16:
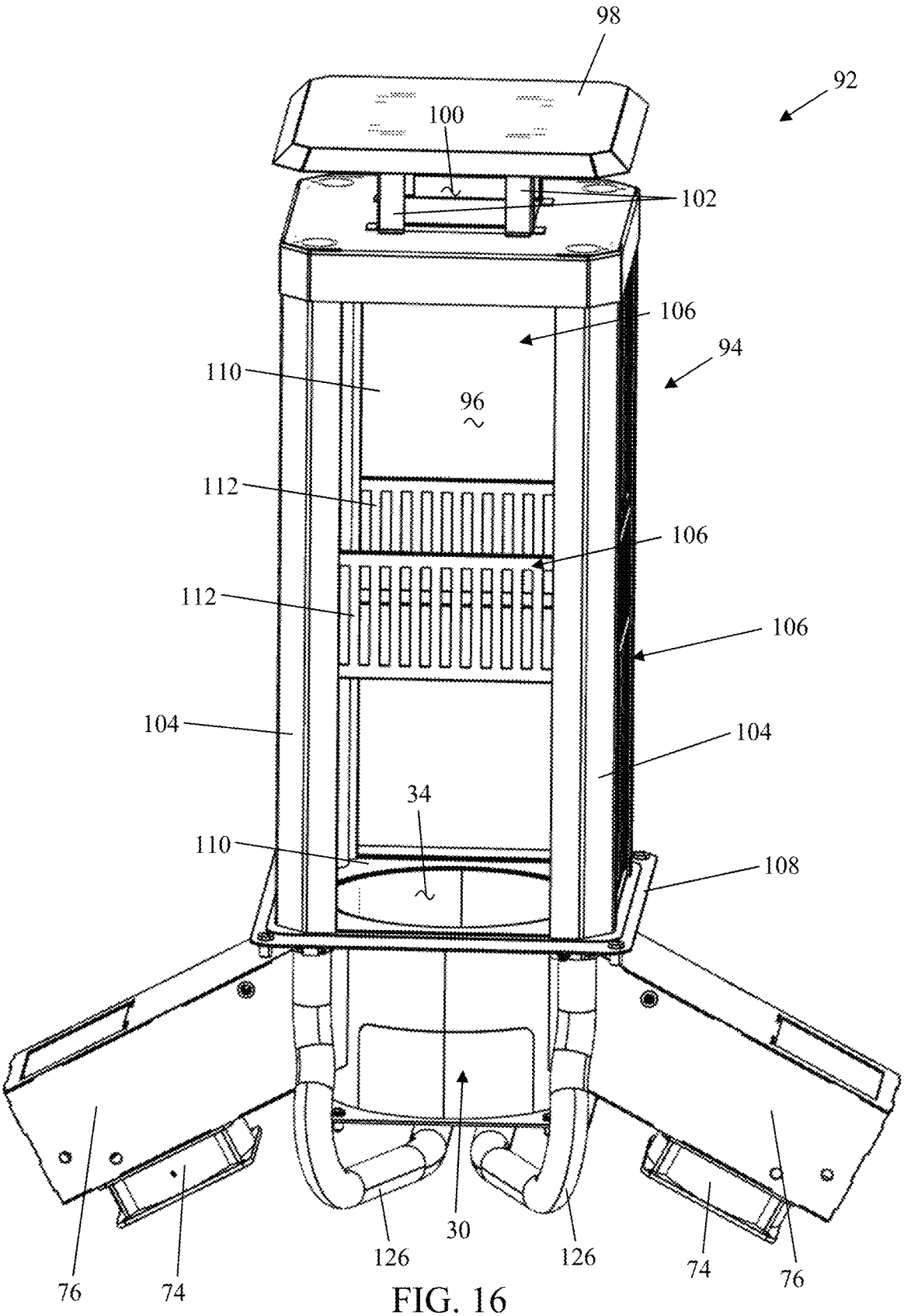
FIG. 16 is a perspective of a flame tower and the burn chamber of the fire pit.
Figure 17:
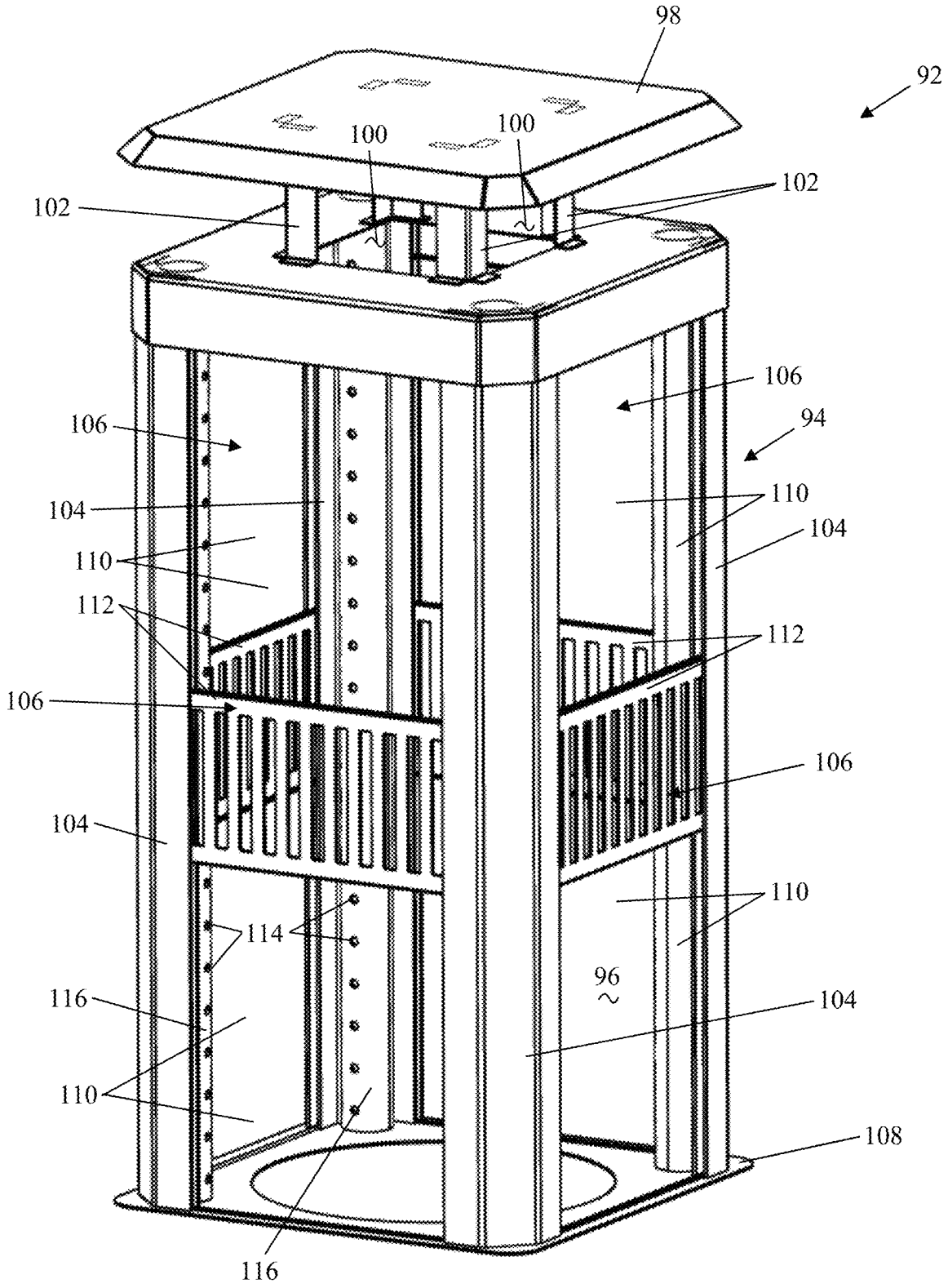
FIG. 17 is a perspective of the flame tower.

Referring to FIGS. 5-11, the fuel delivery system 42 includes a fuel valve 56 for selectively permitting and blocking the flow of fuel from the hopper 44 to the fuel conveyor 46. Broadly, the fuel valve 56 is configurable in an open position (FIG. 10) where the fuel valve permits movement of the fuel toward the combustion space 34 of the burn chamber 30 and a closed position (FIGS. 5 and 11) where the fuel valve blocks movement of the fuel toward the combustion space of the burn chamber. The fuel valve 56 includes a valve member 58 movable between open and closed positions (to configure the fuel valve in the respective open and closed configurations) and an actuator 60 for moving the valve member between the open and closed positions. In the illustrated embodiment, the valve member 58 comprises a grate that slides between the open and closed positions. The grate includes a plurality of ribs or rods 62 mounted to a rib support or bar 64. The fuel valve 56 is disposed at the outlet of the hopper 44. In the closed position, the ribs 62 extend across the outlet of the hopper 44. The actuator 60 includes a handle or knob 66 and a push/pull rod 68. One of the push/pull rod 68 is attached to the rib support 64 and the other end is attached to the handle 66. To open the fuel valve 56, the user pushes the handle 66 toward the hopper 44. This causes the ribs 62 to slide out of the outlet of the hopper 44 to open the outlet to permit the fuel in the hopper to flow (e.g., fall) toward the fuel inlet 48 of the fuel conveyor 46. To close the fuel valve 56, the user reverses the motion. The user pulls the handle 66 away from the hopper 44. This causes the ribs 62 to slide into the outlet of the hopper 44 to close the outlet to block the fuel in the hopper from moving toward the fuel inlet 48 of the fuel conveyor 46. The handle 66 is disposed in the interior 20 of the base 12 and the user can open the doors 22 to access the handle (see FIGS. 14 and 15). Other valve configurations are within the scope of the present disclosure. For example, in one embodiment the actuator is a prime mover (such as an electric motor, linear actuator, etc.) for moving the valve member between the open and closed positions.

As mentioned above, the illustrated fire pit 10 includes two fuel delivery systems 42. The two (e.g., first and second) fuel delivery systems 42 are arranged to deliver fuel to different portions of the combustion space 34 of the burn chamber 30. The fuel conveyor 46 (e.g., a first fuel conveyor) of one fuel delivery system 42 is arranged to deliver the fuel to one side of the combustion space 34 of the burn chamber 30 and the fuel conveyor (e.g., a second fuel conveyor) of the other fuel delivery system is arranged to deliver fuel to the opposite side of the combustion space of the burn chamber. Two or more fuel delivery systems 42 provides additional pellet capacity, longer operation time before reloading fuel, and/or a more centralized gathering of the fuel in the combustion space 34 for better burning. In one embodiment, the fuel is fed from both fuel delivery systems 42 at the same time. In another embodiment, the fuel is fed from one fuel delivery system 42 and then the other. The fuel delivery systems 42 can switch continuously during operation or one fuel delivery system can delivery fuel until empty and then the fire pit 10 switches over to the other fuel delivery system. In one embodiment, the fuel conveyors of the fuel delivery systems are powered by the same prime mover, such as by drive train operatively coupling the two fuel conveyors together.

Referring to FIGS. 6-9, the fire pit 10 includes a combustion air supply system 70 (e.g., a first air supply system) configured to deliver air to the combustion space 34 of the burn chamber 30. Directing air into the combustion space 34 facilitates a rapid and complete combustion of the fuel, which results in larger flames for the vortex effect (described below), as well as allowing the fire pit to control the burn rate of the fuel. The combustion air supply system 70 is supported by the base 12 and is contained within the interior 20 of the base. This further facilitates the finished and appeasing appearance of the fire pit 10. In the illustrated embodiment, the fire pit 10 includes two combustion air supply systems 70, which are generally mirror images of one another. Accordingly, one combustion air supply system 70 will now be described with the understanding the description also applies to the other combustion air supply system. The fire pit 10 may include more or fewer than two combustion air supply systems 70.

The combustion air supply system 70 includes ducting 72 and a blower 74. The ducting 72 is arranged to deliver air to the combustion space 34 of the burn chamber 30. The ducting 72 forms a passageway leading from the blower 74 to the burn chamber 30 for guiding the air moved by the blower into the combustion space 34. The blower 74 is configured to move or blow air in the ducting 72 toward the combustion space 34 of the burn chamber 30. The blower 74 includes a prime mover (e.g., electric motor) and a fan blade rotated by the prime mover. In the illustrated embodiment, the ducting 72 includes a main duct 76. The blower 74 is attached to an underside of the main duct 76 and blows air into the main duct from the interior 20 of the base 12. The air drawn into the main duct 76 by the blower 74 from the interior 20 is replaced by air flowing under the base 12 through the gap between the shroud 18 and the support surface and into the interior of the base 12. The ducting 72 includes an air outlet 78 through which air leaves the main duct 76 and enters the burn chamber 30. Air leaves the air outlet 78, enters the ash tray receiving space 38 and then flows into the combustion space 34. The air outlet 78 is positioned at one end of the main duct 76. The main duct 76 generally surrounds the fuel conveyor 46 of a fuel delivery system 42. As a result, the air flowing through the main duct 76 cools the fuel conveyor 46.

As mentioned above, the illustrated fire pit 10 includes two combustion air supply systems 70. The two (e.g., first and second) combustion air supply systems 70 are arranged to deliver air to different portions of the burn chamber 30. One combustion air supply system 70 is arranged to deliver air to one side of the burn chamber 30 and the other combustion air supply system is arranged to deliver air to the opposite side of the burn chamber. This provides a more even air flow to the combustion space 34, resulting in a more uniform burning of the fuel in the combustion space.

Figure 12:
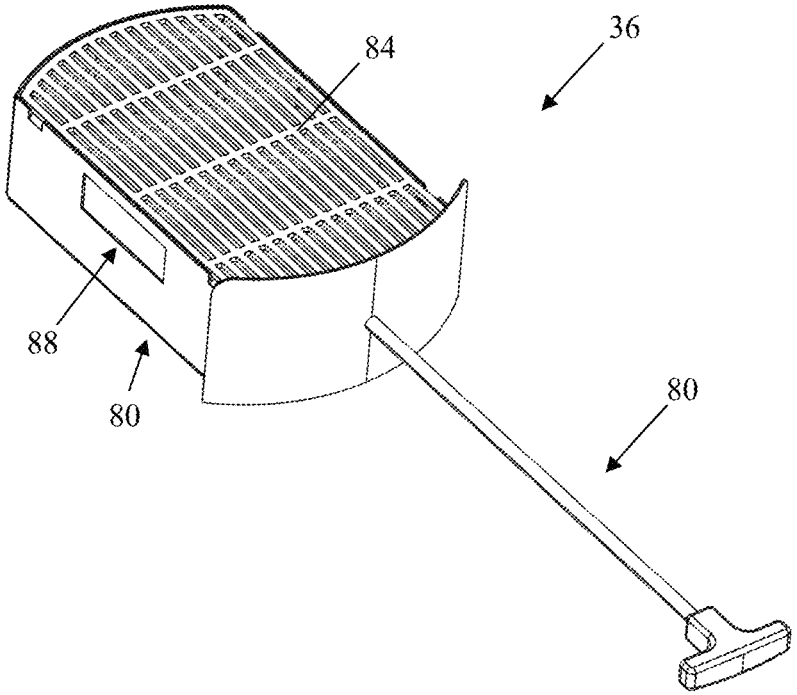
FIG. 12 is a perspective of an ash tray of the fire pit.
Figure 13:
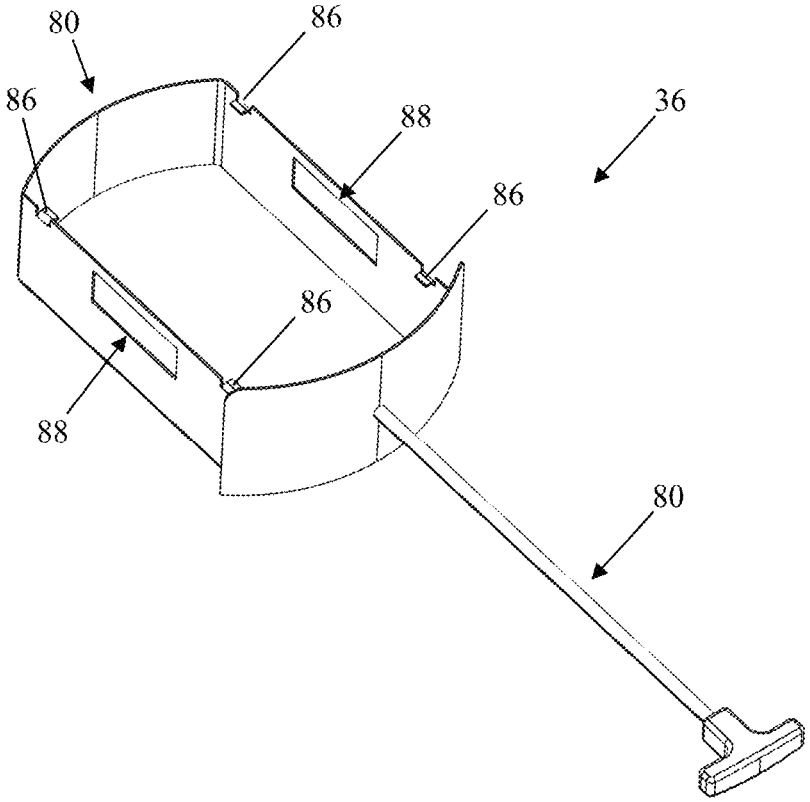
FIG. 13 is a perspective of the ash tray with a grate thereof removed.
Figure 13A:
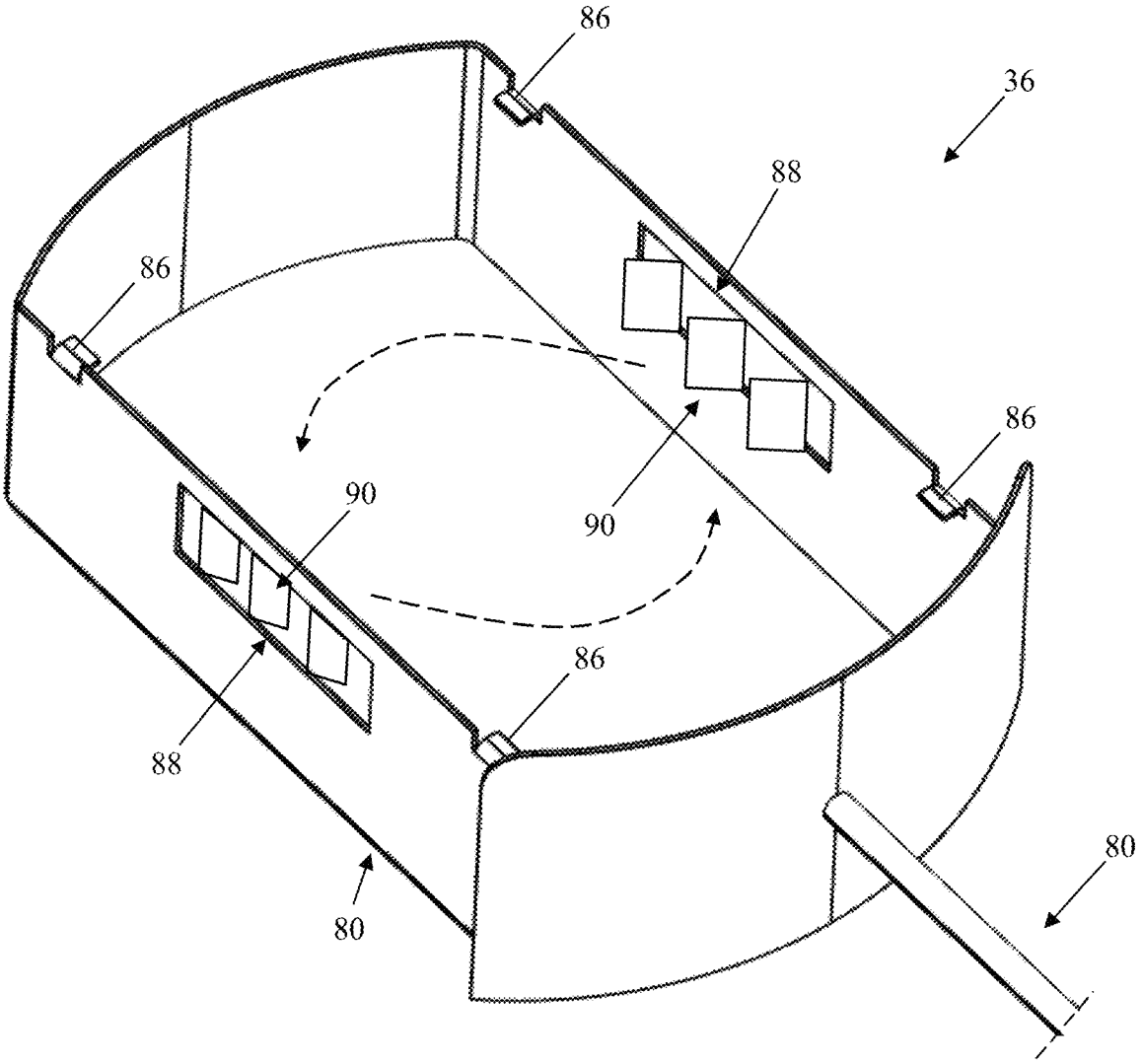
FIG. 13A is a perspective of an ash tray, with the grate thereof removed, according to another embodiment of the present disclosure.

Referring to FIGS. 12-13A, the ash tray 36 includes a bin 80 having a base and a plurality of side walls extending up from the base. The ash tray 36 includes a handle 82 attached to the bin 80, which is used by the user to move the ash tray along the ash tray support 40 and into and out of the ash tray receiving space 38 of the burn chamber 30. The ash tray 36 includes a grate 84 supported by the bin 80, at the upper end thereof. When the ash tray 36 is disposed in the ash tray receiving space 38 of the burn chamber 30, the grate 84 forms a portion of the floor of the burn chamber 30 on which the fuel burns. As the fuel burns, the ashes fall through the grate 84 and into the bin 80. The grate 84 is removably coupled to the bin 80. In the illustrated embodiment, the bin 80 includes a plurality of grate supports or tabs 86 on which the grate 84 rests. The user lifts the grate 84 off the grate supports 86 to remove the grate and places the grate on the grate supports to mount the grate on the bin 80. When positioned on the grate supports 86, the grate 84 is disposed between and held in place by the upper edge margins of the side walls of the bin 80. The bin 80 includes air inlets 88 through which air delivered by the combustion air supply systems 70 enter the bin. When the ash tray 36 is disposed in the ash tray receiving space 38 of the burn chamber 30, each air inlets 88 is aligned (e.g., horizontally and vertically aligned) with an air outlet 78 of the combustion air supply systems 70. Air leaves the air outlets 78 of the combustion air supply systems 70, flows into the ash tray receiving space 38, into the bin 80 through the air inlets 88, and up through the grate 84 into the combustion space 34. In one embodiment, as shown in FIG. 13A, the ash tray 36 includes one or more baffles or deflectors 90 arranged such that the air flows in a circular fashion as the air flow inside the bin 80 and up through the grate 84 into the combustions space 34. This facilitates the complete burning of the fuel in the burn chamber 30 and assists in creating the vortex effect on the flames produced by the burning fuel, as described in more detail below. Desirably the baffles 90 are arranged to rotate the air flow in the same direction (e.g., counter-clockwise) as the rotation of air that produces the vortex effect on the flames.

In one embodiment, the base 12 includes one or more heat distributers (not shown) for distributing some of the heat produced by the burning fuel laterally outward to heat the area around the fire pit 10, such as where people may be siting. The heat distributers generally take heat from the interior 20 of the base 12 and direct it to the area surrounding the fire pit 10. For example, the heat distributes take the air in the interior 20 of the base 12, which is heated by the burn chamber 30, and directs it outward to the area surrounding the fire pit 10. In one embodiment, the heat distributer includes one or more vents disposed on the outside of the base 12, such as on the shroud 18. The heat distributer may include a blower for moving air through the vent. In one embodiment, the heat distributer may include ducting for guiding the air moved by the blower to and through the one or more vents. The blower may be inside or outside the interior 20 of the base 12. In one embodiment, the blower of the heat distributer takes air from the interior 20 of the base 12, which is heated by the burn chamber 30, and directs it out of the one or more vents. In one embodiment, the ducting of the heat distributer extends along and is in conductive heat transfer contact with the burn chamber 30 such that the air is heated by the burn chamber as the air moves through the ducting. In other configurations, other blowers of the fire pit, such as the blowers for the burn chamber 30 and/or fire tower (described below) could be used to force air out of the one more vents. Other configurations of the heat distributer are within the scope of the present disclosure.

Referring to FIGS. 1-4 and 16-18, the fire pit 10 includes a flame tower 92 for containing and displaying the flames produced by the flue burning in the burn chamber 30. The flame tower 92 is supported by the base 12. The flame tower 92 extends upward from the base 12. The flame tower 92 is disposed above the burn chamber 30. In the illustrated embodiment, the flame tower 92 is generally disposed in the center of the platform 16, with the tabletop surface 28 surrounding the flame tower. The flame tower 92 includes a flame tower housing 94 having a flame tower interior 96. The flame tower interior 96 is arranged to receive the flames produced by the fuel as the fuel burns in the combustion space 34 of the burn chamber 30. The flame tower interior 96 includes an open lower end for receiving the flames and gases produced by the burning fuel and an open upper end for venting the gases (and other products of combustion) to the surrounding atmosphere. The flame tower 92 includes a heat deflector 98 above the flame tower housing 94. The heat deflector 98 overlies the flame tower interior 96. The head deflector 98 is configured to direct heat from the flames (broadly, the burning fuel) laterally outward, such as toward observers positioned around the fire pit 10. The heat deflector 98 also acts as a roof of the flame tower 92. The flame tower 92 includes openings or vents 100 between the heat deflector 98 and the flame tower housing 94 to permit the products of combustion (e.g., gas, fumes, heat, soot, etc.) to vent into the surrounding atmosphere. In the illustrated embodiment, the heat deflector 98 is connected to (and spaced apart from) the flame tower housing 94 by brackets 102. The heat deflector 98 may be fixed to or removably coupled to the flame tower housing 94. For example, the heat deflector 98 may be removed for cleaning. In one embodiment, the brackets 102 removably couple the heat deflector 98 to the flame tower housing 94. For example, the brackets 102 may have openings, such as slots, for receiving fasteners (e.g., screws, bolts, etc.) through openings in the flame tower housing. In one embodiment, the heat deflector 98 is positionable relative to the flame tower housing 94 in a deployed or operational position and a stowed position. In the operational position, the heat deflector 98 is in the position generally shown in FIGS. 16 and 17, in which the heat deflector deflects heat and the vents 100 are open. In the stowed position (not shown), the heat deflector 98 is generally collapsed downward to act as a protective cover for the flame tower housing 94. The heat deflector 98 generally rests on the flame tower housing 94, closing the vents 100 to inhibit access to the flame tower interior 96 through the vents. In one embodiment, the brackets 102 can hold the heat deflector 98 in the operational and stowed positions.

In the illustrated embodiment, the flame tower housing 94 has a rectangular (e.g., square) cross-sectional shape. The flame tower housing 94 includes four columns or posts 104 and four side walls 106 extending between the columns. The columns 104 extend upward from a flame tower base (e.g. flame tower base plate) 108 of the flame tower housing 94. Each side wall 106 includes at least one translucent or transparent panel 110. In the illustrated embodiment, each side wall 106 includes two translucent or transparent panels 110 with a vent grate 112 disposed therebetween at about the middle of the side wall 106. The vent grate 112 may be disposed at other positions along the side wall 106, such as at the bottom or at the top of the side wall. In one embodiment, the vent grate 112 is omitted from the side wall 106. The panels 110 permit a viewer to view the flames within the flame tower interior 96. The panels 110 are translucent or transparent to enable the viewer to see inside the flame tower 92. The one or more panels 110 of each side wall 106 are arranged to permit a viewer to observe the flames disposed in the flame tower interior 96 from a side of the fire pit 10. Taken together, the plurality of panels 110 of the side walls 106 are arranged to permit the viewer to observe the flames disposed within the flame tower interior 96 from all sides of the fire pit 10. This encourages viewers to gather around and surround the fire pit 10, maximizing the number of viewers who can observe the flames produced by the fire pit. The panels 110 may be made of glass or any other suitable material. In one embodiment, one or more of the side walls 106 are opaque to obstruct the view of the flame to create directional viewing of the flame.

The flame tower 92 imparts a vortex effect on the flames produced by the burning fuel. The vortex effect results in the flames generally spiraling around one another as they extend upward in the flame tower interior 96, providing an interesting and captivating effect for the viewers to observe. The flame tower 92 includes a plurality of air outlets 114 for producing the vortex effect. The air outlets 114 are oriented to direct air into the flame tower interior 96 in a manner that imparts the vortex effect on the flames produced by the burning of the fuel in the combustion space 34 of the burn chamber 30. The air outlets 114 are directional and direct air into the flame tower interior 96 in a specific direction to produce the vortex effect. Broadly, the plurality of air outlets 114 includes at least a first portion of air outlets and a second portion of air outlets. The first and second portions of air outlets are arranged vertically along the flame tower interior 96. The air outlets of the first portion are oriented to direct the air in a first direction and the air outlets of the second portion are oriented to direct air in a second direction different from the first direction. Desirably, the second direction is generally opposite the first direction. Desirably, the first and second portions of air outlets are laterally offset from one another. As a result of this configuration, the air is delivered to the flame tower interior 96 by the air outlets 114 moves in a circular fashion within the flame tower interior. The circular movement of the air within the flame tower interior 96 creates the vortex effect on the flames.

Figure 18:
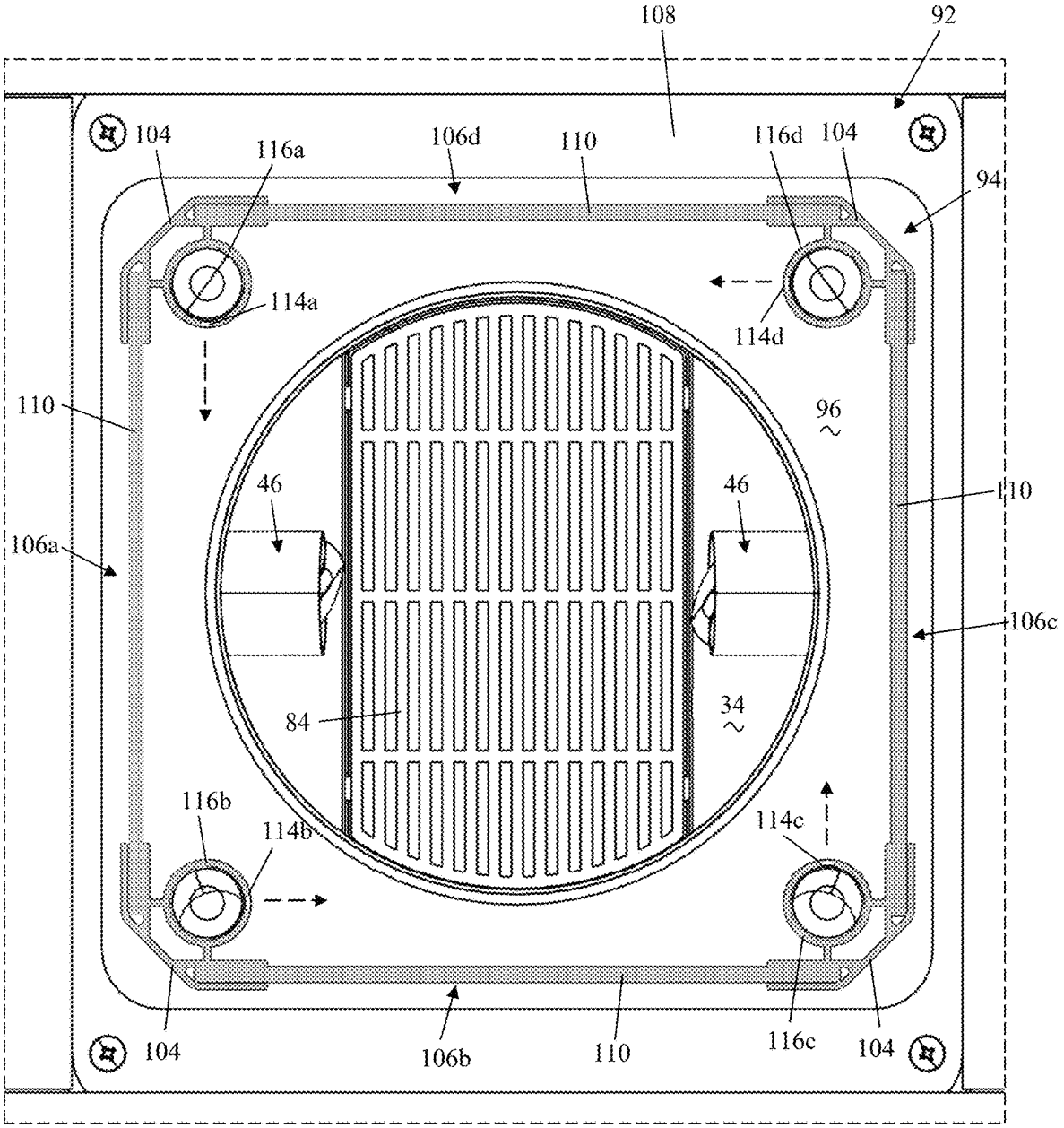
FIG. 18 is a cross-section of the flame tower.

With reference to FIG. 18, in the illustrated embodiment, the flame tower 92 includes four vertical duct or tubes (broadly, plenums) 116 inboard of the columns 104. Each duct 116 is generally positioned in one of the corners of the flame tower housing 94. The air outlets 114 are spaced along each duct 116 in a row to deliver the air to the flame tower interior 96. Accordingly, the air outlets 114 are spaced along generally the entire height of the flame tower interior 96. A first portion of air outlets 114*a* is spaced vertically along the first duct 116*a*. These air outlets 114*a* are oriented to direct air toward the second duct 116*b* (e.g., widthwise across the flame tower interior 96). Moreover, these air outlets 114*a* direct air along the first side wall 106*a*. A second portion of air outlets 114*b* is spaced vertically along the second duct 116*b*. These air outlets 114*b* are oriented to direct air toward the third duct 116*c* (e.g., widthwise across the flame tower interior 96). Moreover, these air outlets 114*b* direct air along the second side wall 106*b*. A third portion of air outlets 114*c* is spaced vertically along the third duct 116*c*. These air outlets 114*c* are oriented to direct air toward the fourth duct 116*d* (e.g., widthwise across the flame tower interior 96). Moreover, these air outlets 114*c* direct air along the third side wall 106*c*. A fourth portion of air outlets 114*d* is spaced vertically along the fourth duct 116*d*. These air outlets 114*d* are oriented to direct air toward the first duct 116*a* (e.g., widthwise across the flame tower interior 96). Moreover, these air outlets 114*d* direct air along the fourth side wall 106*d*. As shown in FIG. 18, the air outlets 114*a*, 114*c* of the first and third portions direct air in general opposite directions and from a laterally offset position with respect to the air outlets of the other respective portion. Likewise, the air outlets 114*b*, 114*d* of the second and fourth portions direct air in general opposite directions and from a laterally offset position with respect to the air outlets of the other respective portion. This results in the air within the flame tower interior 96 moving in a circular (e.g., counter-clockwise) fashion to create the vortex effect on the flames. In addition to creating the vortex effect, this arrangement directs air along (e.g., directly along) the full height of the side walls 106 which reduces ash and carbon buildup on the side walls. Other configurations and arrangements of the air outlets are within the scope of the present disclosure.

Referring back to FIGS. 4-9, the fire pit 10 includes a vortex air supply system 118 (e.g., second air supply system) configured to supply air to the air outlets 114. The vortex air supply system 118 is supported by the base 12 and is contained within the interior 20 of the base. The vortex air supply system 118 includes ducting 120 and a blower 122. The ducting 120 is arranged to deliver air to the air outlet 114. The ducting 120 forms one or more passageways leading from the blower 122 to the air outlets 114 for guiding the air moved by the blower into the flame tower interior 96. The blower 122 is configured to move or blow air in the ducting 120 toward the air outlets 114. The blower 122 includes a prime mover (e.g., electric motor) and a fan blade rotated by the prime mover. In the illustrated embodiment, the ducting 120 includes a manifold 124 and four supply ducts 126 extending downstream of the manifold. Each supply duct 126 is coupled (e.g., fluidly coupled) to one of the ducts 116 of the flame tower 92. The blower 122 is attached to manifold 124 and blows air into the manifold from the interior 20 of the base 12. The air drawn by the blower 122 from the interior 20 is replaced by air flowing under the base 12 through the gap between the shroud 18 and the support surface and into the interior of the base 12. The air blown by the blower 122 flows through the manifold 124, through the supply ducts 126, into the vertical ducts 116 and out the air outlets 114 into the flame tower interior 96.

In one embodiment, the flame tower 92 is designed in a manner that allows a user to easily remove the flame tower from the base 12. This may be useful for cleaning purposes. For example, the flame tower 92 can be held in place by reception of the end portions of the supply ducts 126 in the vertical ducts 116 of the flame tower, as shown. Fasteners may be used to secure and hold the flame tower 92 (e.g., base 108 thereof) to the base 12 (e.g., the framework 114). In another example, an air tube lug could be used with a keyed opening in the base, where misalignment of the lug with the keyed opening prevents removal of the flame tower but alignment permits removal. In another example, the flame tower and the base may be configured to form a turn connection where the flame tower is located on the base and turned to form a releasable connection (e.g., lugs in slots), and turned in an opposite direction to release the connection. In another example, a mechanical locking mechanism, such as a lever or set screw, could be used to connect or stabilize the flame tower respect to the base. Other configurations are within the scope of the present disclosure.

Figure 19:
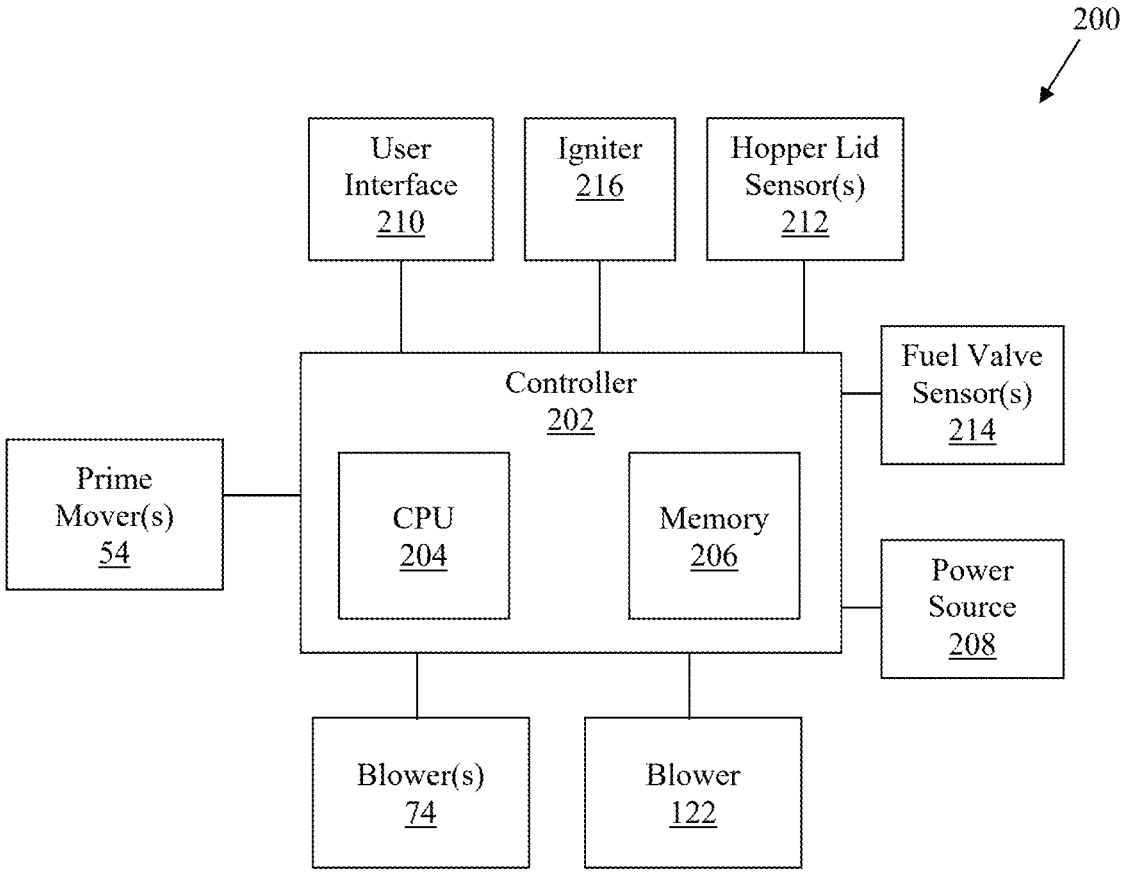
FIG. 19 is a schematic diagram of a control system of the fire pit according to one embodiment of the present disclosure.

Referring to FIG. 19, one embodiment of a control system of the fire pit 10 is generally indicated by reference numeral 200. The control system 200 includes a controller 202 (broadly, a computer) for controlling the operation of the fire pit 10. The controller 202 controls and operates the components (e.g., prime mover(s) 54, blowers 74, 122, etc.) of the fire pit 10. The controller 202 has control circuitry which includes a CPU or processor 204 (e.g., a fire pit processor) and RAM or memory 206 (broadly, non-transitory computer readable storage medium). Broadly, the memory 206 includes (e.g., stores) processor-executable instructions for controlling the operation of the fire pit 10 and the components thereof. The instructions embody one or more of the functional aspects of the fire pit 10 and the components thereof (as described herein), with the processor 202 executing the instructions to perform said one or more functional aspects. The components of the fire pit 10 may be in wired or wireless communication with the controller 202. Other configurations of the control system 200 are within the scope of the present disclosure.

The controller 202 operates the fuel conveyors 46 (e.g., prime movers 54 thereof) to control the rate the fuel is fed to the burn chamber 30. The controller 202 also operates the combustion air supply systems 70 (e.g., blowers 74 thereof) to control the burn rate (e.g., how fast or slow the fuel burns) of the fuel in the burn chamber 30. The controller 202 may be set to operate the combustion air supply systems 70 to supply air as a set rate or a variable rate. For example, the controller 202 may operate the combustion air supply systems 70 to deliver more air to the combustion space 34 of the burn chamber 30 as the feed rate of fuel increases and reduce the amount of air delivered as the feed rate of fuel decreases. The controller 202 also operates the vortex air supply system 118 (e.g., the blower 122 thereof) to generate the vortex effect in of the flames in the flame tower 92. The controller 202 is connected to a power source 208 which supplies power to the fire pit 10. The power source 208 may be a power cord to a wall outlet or a rechargeable battery pack. The battery back may be removably connected to a dock in the interior 20 of the base 12 or outside the interior of the base. The control system 200 includes a user interface 210, such as buttons, dials, knob, switch, etc., for receiving user inputs. The user interface 210 may be disposed in the interior 20 of the base 12 and accessible by opening the doors 22 or may be disposed on an exterior (e.g., shroud 18) of the base. In one embodiment, the user interface 210 comprises a rotary knob for turning the fire pit on and controlling the size of the fire. For example, turning the rotary knob in a first direction can turn the fire pit 10 on (e.g., the controller 202 operates the prime movers 54 of the fuel conveyors 46 to deliver fuel to the burn chamber 30, operates the blowers 74 of the combustion air supply systems 70 to deliver air to the burn chamber, and operates the blower 122 of the vortex air supply system 118 to deliver air to the flame tower interior 96). Continuing to turn the rotary knob in the first direction can increase the rate at which the fuel conveyors 46 deliver fuel to the burn chamber 30, increasing the size of the fire. Likewise, rotating the rotary knob in an opposite second direction can decrease the rate at which the fuel conveyors 46 deliver fuel to the burn chamber 30, decreasing the size of the fire. Continuing to turn the rotary knob in the second direction can turn the fire pit 10 off (e.g., stop the prime movers 54 and the blowers 74, 122).

In one embodiment, the control system 200 may include a hopper lid sensor 212 arranged to detect whether or not the lid (e.g., the middle panel 24 of the platform 16) for the hopper 44 is opened or closed. If the hopper lid sensor 212 detects that the lid is opened, the controller 202 can stop the fuel conveyors 46. This provides a safety measure to ensure a person is not accidentally injured by the fuel conveyor 46 when the lid is open and the user is loading the fuel into the hopper 44. The hopper lid sensor 212 may be any suitable sensor such as a contact switch, a proximity switch, a hall effect sensor, and the like. It is understood the control system 200 would include a hopper lid sensor 212 for each hopper 44 of the fire pit 10.

In one embodiment, the control system 200 may include a fuel valve sensor 214 arranged to detect if the fuel valve 56 is opened or closed. If the fuel valve sensor 214 detects that the fuel valve 56 is closed, the controller 202 can enter into a shutdown mode in which the controller continues to operate the components of the fire pit 10 as normal for a certain period of time (e.g., 10-15 minutes) and then shuts the components (e.g., blowers 74, 122) off. This allows enough time for the remaining fuel in the burn chamber 30 to burn up. In one embodiment, the controller 202 continues to operate the fuel conveyors 46 during the shutdown mode to deliver any remaining fuel in the fuel conveyors to the burn chamber 30 to burn up. This may be necessary to prevent the fuel in the fuel conveyors 46 from igniting and burning. In one embodiment, the controller 202 stops the fuel conveyors 46 from delivering any more fuel upon entering the shutdown mode. The fuel valve sensor 214 may be any suitable sensor such as a contact switch, a proximity switch, a hall effect sensor, and the like. It is understood the control system 200 would include a fuel valve sensor 214 for each fuel valve 56 of the fire pit 10. Other ways of entering the shutdown mode are within the scope of the present disclosure. For example, the user can operate the user interface (e.g., press a button, turn a knob, flip a switch, etc.) to enter the shutdown mode to turn the fire pit off. In one embodiment, where the actuator 60 of the fuel valve 56 comprises a prime mover, the controller 202 can operate the prime mover to close the fuel valve when the user initiates the shutdown mode and can operate the prime mover to open the fuel valve when the user turns the fire pit on via the user interface 210.

In one embodiment, the control system 200 includes an igniter 216 configured to ignite the fuel within the burn chamber 30 and start the fire. In one method of operation, when the user turns the fire pit 10 on via the user interface 210, the controller 202 inters a startup mode in which the controller operates the fuel conveyors 46 for a certain period of time (e.g., 5-10 minutes) to build up the fuel in the burn chamber 30. After, the controller 202 activates the igniter 216 to ignite the fuel in the burn chamber 30 and turns on the combustion air supply systems 70 and the vortex air supply system 118. In one embodiment, the control system 200 does not include an igniter. In this case, the user can first build a fire in the ash tray 36 and then insert the ash tray (with the burning fire) into the ash tray receiving space 38. For example, the user may place and ignite fire starter sticks, or any other suitable type of fire starter, in the ash tray 36. The initial fire in the ash tray 36 then ignites the fuel in the combustion space 34 of the burn chamber 30. The user may turn the fire pit 10 on before or after inserting the ash tray 36 with the burning fire into the ash tray receiving space 38 to have the fuel conveyors 46 deliver fuel to the burn chamber 30, which is then ignited by the initial fire in the ash tray.

As used herein and in the drawings, when a reference character includes a reference numeral not followed by a letter, such a reference character refers to all elements designated at least in part by the reference numeral. Moreover, when a reference character includes the reference numeral flowed by a letter, such as "a," such a reference character refers to a particular element or sub-group of elements from the group of elements. For example, as used herein and in the drawings, reference numeral "114" designates all air outlets, while reference numeral "114" followed by a letter, such as "114*a*," designates a specific sub-group of air outlets.

It is appreciated that the person of ordinary skill in the art is readily able to determine the scope of terms of degree such as, but not limited to, "about," "substantially," and "generally." For example, when a term of degree is used in relation to a numeric value, the person of ordinary skill in the art understands that the term of degree covers an inclusive range of plus or minus 10% of the numeric value, unless clearly indicated or stated otherwise.

The Title, Field, and Background are provided to help the reader quickly ascertain the nature of the technical disclosure. They are submitted with the understanding that they will not be used to interpret or limit the scope or meaning of the claims. They are provided to introduce a selection of concepts in simplified form that are further described in the Detailed Description. The Title, Field, and Background are not intended to identify key features or essential features of the claimed subject matter, nor is it intended to be used as an aid in determining the claimed subject matter.

When introducing elements of aspects of the disclosure or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the aspects of the disclosure are achieved and other advantageous results attained.

Not all of the depicted components illustrated or described may be required. In addition, some implementations and embodiments may include additional components.

Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the disclosure by way of example and not by way of limitation. This description enables one skilled in the art to make and use the aspects of the disclosure, and describes several embodiments, adaptations, variations, alternatives and uses of the aspects of the disclosure, including what is presently believed to be the best mode of carrying out the aspects of the disclosure. Additionally, it is to be understood that the aspects of the disclosure are not limited in its application to the details of construction and the arrangement of components set forth in the description or illustrated in the drawings. The aspects of the disclosure are capable of other embodiments and of being practiced or carried out in various ways. Also, it will be understood that the phraseology and terminology used herein is for the purpose of description and should not be regarded as limiting.

Having described aspects of the disclosure in detail, it will be apparent that modifications and variations are possible without departing from the scope of aspects of the disclosure as defined in the appended claims. It is contemplated that various changes could be made in the above constructions, products, and methods without departing from the scope of aspects of the disclosure. In the preceding specification, various embodiments have been described with reference to the accompanying drawings. It will, however, be evident that various modifications and changes may be made thereto, and additional embodiments may be implemented, without departing from the broader scope of the aspects of the disclosure as set forth in the claims that follow. The specification and drawings are accordingly to be regarded in an illustrative rather than restrictive sense.

What is claimed is:

1. A fire pit for burning solid pelletized fuel, the fire pit comprising:

a base configured to rest on a support surface;

a burn chamber supported by the base and having a combustion space for burning the pelletized fuel;

a first hopper supported by the base and configured to hold the pelletized fuel;

a first fuel conveyor supported by the base and arranged to dispense the pelletized fuel held by the first hopper toward the combustion space of the burn chamber;

a second hopper supported by the base and configured to hold the pelletized fuel; and a second fuel conveyor supported by the base and arranged to dispense the pelletized fuel held by the second hopper toward the combustion space of the burn chamber.

2. The fire pit of claim 1, further comprising a flame tower extending upward from the base, the flame tower having a flame tower interior arranged to receive flames produced by the burning of the pelletized fuel in the combustion space of the burn chamber.

3. The fire pit of claim 2, wherein the base includes a tabletop surface surrounding the flame tower.

4. The fire pit of claim 2, wherein the flame tower includes a translucent or transparent panel arranged to permit a viewer to observe the flames disposed in the flame tower from a side of the fire pit.

5. The fire pit of claim 4, wherein the flame tower includes a plurality of air outlets oriented to direct air into the flame tower interior in a manner that imparts a vortex effect on the flames produced by the burning of the pelletized fuel in the combustion space of the burn chamber, the fire pit further comprising an air supply system configured to supply air to the plurality of air outlets, the air supply system including ducting arranged to deliver air to the plurality of air outlets and a blower configured to move air in the ducting toward the air outlets.

6. The fire pit of claim 5, wherein the plurality of air outlets includes a first portion of air outlets and a second portion of air outlets, the first and second portions of air outlets being arranged vertically along the flame tower interior, the first portion of air outlets oriented to direct air in a first direction and the second portion of air outlets oriented to direct air in a second direction different from the first direction.

7. The fire pit of claim 6, wherein the second direction is generally opposite the first direction and wherein the first and second portions of air outlets are laterally offset from one another.

8. The fire pit of claim 5, wherein the ducting includes a first vertical duct, a second vertical duct, a third vertical duct, and a fourth vertical duct, a first portion of air outlets of the plurality of air outlets being spaced vertically along the first vertical duct and oriented to direct air toward the second vertical duct, a second portion of air outlets of the plurality of air outlets being spaced vertically along the second vertical duct and oriented to direct air toward the third vertical duct, a third portion of air outlets of the plurality of air outlets being spaced vertically along the third vertical duct and oriented to direct air toward the fourth vertical duct, a fourth portion of air outlets of the plurality of air outlets being spaced vertically along the fourth vertical duct and oriented to direct air toward the first vertical duct.

9. The fire pit of claim 2, wherein the flame tower includes a plurality of translucent or transparent panels arranged to permit a viewer to observe the flames disposed in the flame tower from all sides of the fire pit.

10. The fire pit of claim 2, wherein the flame tower includes a heat deflector overlying the flame tower interior and configured to direct heat from the flames laterally outward.

11. The fire pit of claim 1, wherein the first fuel conveyor is arranged to deliver the pelletized fuel to one side of the combustion space of the burn chamber and the second fuel conveyor is arranged to deliver the pelletized fuel to an opposite side of the combustion space of the burn chamber.

12. The fire pit of claim 1, wherein the first fuel conveyor includes a first fuel outlet through which the pelletized fuel is delivered toward the combustion space of the burn chamber and a first fuel inlet through which the fuel enters the first fuel conveyor, a bottom of the first fuel inlet being disposed at an elevation lower than a bottom of the first fuel outlet.

13. The fire pit of claim 12, wherein the entire first fuel inlet is disposed lower than an elevation of the first fuel outlet.

14. The fire pit of claim 12, further comprising a flame tower disposed above the burn chamber and having a flame tower interior arranged to receive flames produced by the burning of the pelletized fuel in the combustion space of the burn chamber.

15. The fire pit of claim 12, wherein the second fuel conveyor includes a second fuel outlet through which the pelletized fuel is delivered toward the combustion space of the burn chamber and a second fuel inlet through which the pelletized fuel enters the second fuel conveyor, a bottom of the second fuel inlet being disposed at an elevation lower than a bottom of the second fuel outlet.

16. The fire pit of claim 1, wherein the first and second fuel conveyors are each arranged to dispense the pelletized fuel into the combustion space of the burn chamber.

17. The fire pit of claim 1, wherein the fire and second fuel conveyors each comprise an auger configured to rotate about an axis of rotation to move the pelletized fuel toward the combustion space of the burn chamber.

18. The fire pit of claim 1, wherein the burn chamber, the first hopper, the second hopper, the first fuel conveyor, and the second fuel conveyor are disposed in the base.

19. The fire pit of claim 1, further comprising a first lid configured to cover the first hopper.

20. The fire pit of claim 19, further comprising a second lid configured to cover the second hopper.

21. The fire pit of claim 1, wherein the first hopper is disposed in the base, the base having an upper exterior platform and including a first lid configured to cover the first hopper, the first lid forming a portion of the upper exterior platform.

22. The fire pit of claim 21, wherein the first lid is moveable relative to a remainder of the upper exterior platform to permit access to the first hopper.

23. The fire pit of claim 21, wherein the second hopper is disposed in the base, the base including a second lid configured to cover the second hopper, the second lid forming a portion of the upper exterior platform.

24. The fire pit of claim 23, wherein the first and second lids are moveable relative to a remainder of the upper exterior platform to permit access to the respective first and second hoppers.

25. The fire pit of claim 1, further comprising a combustion air supply system supported by the base, the combustion air supply system configured to deliver air to the combustion space of the burn chamber, the combustion air supply system including ducting arranged to deliver air to the combustion space of the burn chamber and a blower configured to move air in the ducting toward the combustion space of the burn chamber.

26. The fire pit of claim 1, wherein the first fuel conveyor includes a first fuel outlet arranged to deliver the pelletized fuel to the combustion space of the burn chamber and a first fuel inlet through which the pelletized fuel enters the first fuel conveyor, the first fuel conveyor arranged to move the pelletized fuel upward to dispense the pelletized fuel from the first fuel outlet at a higher elevation than the pelletized fuel enters the first fuel inlet.

27. The fire pit of claim 26, wherein the first fuel conveyor includes a first fuel mover configured to move the pelletized fuel through the first fuel outlet and into the combustion space of the burn chamber.

28. The fire pit of claim 26, wherein the second fuel conveyor includes a second fuel outlet arranged to deliver the pelletized fuel to the combustion space of the burn chamber and a second fuel inlet through which the pelletized fuel enters the second fuel conveyor, the second fuel conveyor arranged to move the pelletized fuel upward to dispense the pelletized fuel from the second fuel outlet at a higher elevation than the pelletized fuel enters the second fuel inlet.

29. The fire pit of claim 28, wherein the first fuel conveyor includes a first fuel mover configured to move the pelletized fuel through the first fuel outlet and into the combustion space of the burn chamber, and wherein the second fuel conveyor includes a second fuel mover configured to move the pelletized fuel through the second fuel outlet and into the combustion space of the burn chamber.

30. The fire pit of claim 1, wherein the first fuel conveyor includes a first auger configured to rotate about a first axis of rotation, the first fuel conveyor arranged with respect to the base such that the first axis of rotation is oriented at an upward angle as the first axis of rotation extends toward the burn chamber.

31. The fire pit of claim 30, wherein the second fuel conveyor includes a second auger configured to rotate about a second axis of rotation, the second fuel conveyor arranged with respect to the base such that the second axis of rotation is oriented at an upward angle as the second axis of rotation extends toward the burn chamber.

32. The fire pit of claim 1, further comprising a first fuel valve configurable in a first open position in which the first fuel valve permits movement of the pelletized fuel toward the combustion space of the burn chamber and in a first closed position in which the first fuel valve blocks movement of the pelletized fuel toward the combustion space of the burn chamber.

33. The fire pit of claim 32, wherein the first fuel valve is arranged relative to the first hopper and the first fuel conveyor such that in the first open position the first fuel valve permits movement of the pelletized fuel from the first hopper toward the first fuel conveyor and in the first closed position the first fuel valve blocks movement of the pelletized fuel from the first hopper toward the first fuel conveyor.

34. The fire pit of claim 32, further comprising a second fuel valve configurable in a second open position in which the second fuel valve permits movement of the pelletized fuel toward the combustion space of the burn chamber and in a second closed position in which the second fuel valve blocks movement of the pelletized fuel toward the combustion space of the burn chamber.

35. The fire pit of claim 34, wherein:

the first fuel valve is arranged relative to the first hopper and the first fuel conveyor such that in the first open position the first fuel valve permits movement of the pelletized fuel from the first hopper toward the first fuel conveyor and in the first closed position the first fuel valve blocks movement of the pelletized fuel from the first hopper toward the first fuel conveyor, and the second fuel valve is arranged relative to the second hopper and the second fuel conveyor such that in the second open position the second fuel valve permits movement of the pelletized fuel from the second hopper toward the second fuel conveyor and in the second closed position the second fuel valve blocks movement of the pelletized fuel from the second hopper toward the second fuel conveyor.

* * * * *